US010163401B2

(12) United States Patent
Chaji

(10) Patent No.: US 10,163,401 B2
(45) Date of Patent: Dec. 25, 2018

(54) SYSTEM AND METHODS FOR EXTRACTING CORRELATION CURVES FOR AN ORGANIC LIGHT EMITTING DEVICE

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 140 days.

(21) Appl. No.: 15/198,981

(22) Filed: Jun. 30, 2016

(65) Prior Publication Data

US 2016/0307498 A1 Oct. 20, 2016

Related U.S. Application Data

(63) Continuation-in-part of application No. 14/590,105, filed on Jan. 6, 2015, which is a continuation-in-part (Continued)

(30) Foreign Application Priority Data

| | | |
|---|---|---|
| Feb. 4, 2010 | (CA) | 2692097 |
| Jun. 30, 2015 | (CA) | 2896018 |
| Jul. 13, 2015 | (CA) | 2896902 |

(51) Int. Cl.
*G09G 3/3291* (2016.01)

(52) U.S. Cl.
CPC ... *G09G 3/3291* (2013.01); *G09G 2300/0413* (2013.01); *G09G 2320/029* (2013.01); (Continued)

(58) Field of Classification Search
USPC ..... 345/690
See application file for complete search history.

(56) References Cited

U.S. PATENT DOCUMENTS

| | | | |
|---|---|---|---|
| 3,506,851 | A | 4/1970 | Polkinghorn |
| 3,774,055 | A | 11/1973 | Bapat |

(Continued)

FOREIGN PATENT DOCUMENTS

| | | |
|---|---|---|
| CA | 1 294 034 | 1/1992 |
| CA | 2 109 951 | 11/1992 |

(Continued)

OTHER PUBLICATIONS

Ahnood et al.: "Effect of threshold voltage instability on field effect mobility in thin film transistors deduced from constant current measurements"; dated Aug. 2009.

(Continued)

*Primary Examiner* — Srilakshmi K Kumar
*Assistant Examiner* — Chineyere Wills-Burns
(74) *Attorney, Agent, or Firm* — Stratford Managers Corporation

(57) ABSTRACT

A method of compensating for efficiency degradation of an OLED in an array-based semiconductor device having arrays of pixels that include OLEDs, including determining for a plurality of operating conditions interdependency curves relating changes in an electrical operating parameter of said OLEDs and the efficiency degradation of said OLEDs, the plurality of operating conditions can include temperature or initial device characteristics as well as stress conditions to more completely determine interdependency curves for a wide variety of OLEDs. In some cases interdependency curves are updated remotely after fabrication of the array-based device. Some embodiments utilize degradation-time curves and methods which do not require storage of stress history.

7 Claims, 20 Drawing Sheets

Related U.S. Application Data of application No. 14/322,443, filed on Jul. 2, 2014, which is a continuation-in-part of application No. 14/314,514, filed on Jun. 25, 2014, which is a continuation-in-part of application No. 14/286,711, filed on May 23, 2014, which is a continuation-in-part of application No. 14/027,811, filed on Sep. 16, 2013, now Pat. No. 9,430,958, which is a continuation-in-part of application No. 13/020,252, filed on Feb. 3, 2011, now Pat. No. 8,589,100.

(60) Provisional application No. 62/280,457, filed on Jan. 19, 2016, provisional application No. 62/280,498, filed on Jan. 19, 2016.

(52) U.S. Cl.
CPC ..... *G09G 2320/0285* (2013.01); *G09G 2320/043* (2013.01); *G09G 2360/145* (2013.01)

(56) References Cited

U.S. PATENT DOCUMENTS 4,090,096 A 5/1978 Nagami
4,160,934 A 7/1979 Kirsch
4,354,162 A 10/1982 Wright
4,943,956 A 7/1990 Noro
4,996,523 A 2/1991 Bell
5,153,420 A 10/1992 Hack
5,198,803 A 3/1993 Shie
5,204,661 A 4/1993 Hack
5,266,515 A 11/1993 Robb
5,489,918 A 2/1996 Mosier
5,498,880 A 3/1996 Lee
5,557,342 A 9/1996 Eto
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,691,783 A 11/1997 Numao
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,356,029 B1 3/2002 Hunter
6,373,454 B1 4/2002 Knapp
6,392,617 B1 5/2002 Gleason
6,414,661 B1 7/2002 Shen
6,417,825 B1 7/2002 Stewart
6,433,488 B1 8/2002 Bu
6,437,106 B1 8/2002 Stoner
6,445,369 B1 9/2002 Yang
6,475,845 B2 11/2002 Kimura
6,501,098 B2 12/2002 Yamazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,542,138 B1 4/2003 Shannon
6,555,420 B1 4/2003 Yamazaki
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,985 B1 6/2004 Furuhashi
6,771,028 B1 8/2004 Winters
6,777,712 B2 8/2004 Sanford
6,777,888 B2 8/2004 Kondo
6,781,567 B2 8/2004 Kimura
6,792,157 B1 9/2004 Koshi
6,806,497 B2 10/2004 Jo
6,806,638 B2 10/2004 Lin
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae

(56) References Cited

U.S. PATENT DOCUMENTS 6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 * 4/2008 Leon ..... G09G 3/3233 345/101
7,358,941 B2 4/2008 Ono
7,368,868 B2 5/2008 Sakamoto
7,411,571 B2 8/2008 Huh
7,414,600 B2 8/2008 Nathan
7,423,617 B2 9/2008 Giraldo
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,339,386 B2 12/2012 Leon
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0026725 A1 10/2001 Petteruti et al.
2001/0030323 A1 10/2001 Ikeda
2001/0035863 A1 11/2001 Kimura
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167474 A1 11/2002 Everitt
2002/0180369 A1 12/2002 Koyama
2002/0180721 A1 12/2002 Kimura
2002/0181276 A1 12/2002 Yamazaki
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122813 A1 7/2003 Ishizuki
2003/0142088 A1 7/2003 LeChevalier
2003/0151569 A1 8/2003 Lee
2003/0156101 A1 8/2003 Le Chevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate

(56) References Cited

U.S. PATENT DOCUMENTS

2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0239596 A1 12/2004 Ono
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0110420 A1* 5/2005 Arnold ..... G09G 3/3225 315/169.3
2005/0110807 A1 5/2005 Chang
2005/0140598 A1 6/2005 Kim
2005/0140610 A1 6/2005 Smith
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0248515 A1 11/2005 Naugler
2005/0269959 A1 12/2005 Uchino
2005/0269960 A1 12/2005 Ono
2005/0270204 A1* 12/2005 Zhang ..... G09G 3/3275 341/144
2005/0270537 A1* 12/2005 Mian ..... G01N 21/538 356/437
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007249 A1 1/2006 Reddy
2006/0012310 A1 1/2006 Chen
2006/0012311 A1 1/2006 Ogawa
2006/0022305 A1 2/2006 Yamashita
2006/0027807 A1 2/2006 Nathan
2006/0030084 A1 2/2006 Young
2006/0038758 A1 2/2006 Routley
2006/0038762 A1 2/2006 Chou
2006/0056082 A1* 3/2006 Hung ..... H04N 5/217 359/819
2006/0066533 A1 3/2006 Sato
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103611 A1 5/2006 Choi
2006/0132634 A1 6/2006 Kudoh
2006/0139254 A1* 6/2006 Hayakawa ..... G09G 3/3216 345/76
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0232522 A1 10/2006 Roy
2006/0244697 A1 11/2006 Lee
2006/0261841 A1 11/2006 Fish
2006/0273997 A1 12/2006 Nathan
2006/0279481 A1 12/2006 Haruna
2006/0284801 A1 12/2006 Yoon
2006/0284895 A1 12/2006 Marcu
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103419 A1 5/2007 Uchino
2007/0115221 A1 5/2007 Buchhauser
2007/0164664 A1 7/2007 Ludwicki
2007/0182671 A1 8/2007 Nathan
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036708 A1 2/2008 Shirasaki
2008/0042942 A1 2/2008 Takahashi
2008/0042948 A1 2/2008 Yamashita
2008/0048951 A1 2/2008 Naugler, Jr.
2008/0055209 A1 3/2008 Cok
2008/0055211 A1 3/2008 Takashi
2008/0074413 A1 3/2008 Ogura
2008/0088549 A1 4/2008 Nathan
2008/0088648 A1* 4/2008 Nathan ..... G09G 3/3233 345/690
2008/0111766 A1 5/2008 Uchino
2008/0116787 A1 5/2008 Hsu
2008/0117144 A1 5/2008 Nakano
2008/0150845 A1 6/2008 Masahito
2008/0150847 A1 6/2008 Kim
2008/0158115 A1 7/2008 Cordes
2008/0158648 A1 7/2008 Cummings
2008/0198103 A1 8/2008 Toyomura
2008/0211749 A1 9/2008 Weitbruch
2008/0231558 A1 9/2008 Naugler
2008/0231562 A1 9/2008 Kwon
2008/0231625 A1 9/2008 Minami
2008/0252223 A1 10/2008 Hirokuni
2008/0252571 A1 10/2008 Hente
2008/0259020 A1 10/2008 Fisekovic

(56) References Cited

U.S. PATENT DOCUMENTS

| | | | | |
|---|---|---|---|---|
| 2008/0290805 | A1 | 11/2008 | Yamada | |
| 2008/0297055 | A1 | 12/2008 | Miyake | |
| 2009/0058772 | A1 | 3/2009 | Lee | |
| 2009/0109142 | A1 | 4/2009 | Hiroshi | |
| 2009/0121994 | A1 | 5/2009 | Miyata | |
| 2009/0146926 | A1 | 6/2009 | Sung | |
| 2009/0160743 | A1 | 6/2009 | Tomida | |
| 2009/0174628 | A1 | 7/2009 | Wang | |
| 2009/0184901 | A1 | 7/2009 | Kwon | |
| 2009/0195483 | A1 | 8/2009 | Naugler, Jr. | |
| 2009/0201281 | A1 | 8/2009 | Routley | |
| 2009/0206764 | A1 | 8/2009 | Schemmann | |
| 2009/0213046 | A1 | 8/2009 | Nam | |
| 2009/0244046 | A1 | 10/2009 | Seto | |
| 2010/0004891 | A1 | 1/2010 | Ahlers | |
| 2010/0039422 | A1 | 2/2010 | Seto | |
| 2010/0039458 | A1 | 2/2010 | Nathan | |
| 2010/0060911 | A1 | 3/2010 | Marcu | |
| 2010/0079419 | A1 | 4/2010 | Shibusawa | |
| 2010/0165002 | A1 | 7/2010 | Ahn | |
| 2010/0194670 | A1 | 8/2010 | Cok | |
| 2010/0207960 | A1 | 8/2010 | Kimpe | |
| 2010/0225630 | A1 | 9/2010 | Levey | |
| 2010/0251295 | A1 | 9/2010 | Amento | |
| 2010/0277400 | A1 | 11/2010 | Jeong | |
| 2010/0315319 | A1 | 12/2010 | Cok | |
| 2011/0063197 | A1 | 3/2011 | Chung | |
| 2011/0069051 | A1 | 3/2011 | Nakamura | |
| 2011/0069089 | A1 | 3/2011 | Kopf | |
| 2011/0074750 | A1 | 3/2011 | Leon | |
| 2011/0084701 | A1* | 4/2011 | Bancken ..... | H05B 33/0818 324/414 |
| 2011/0149166 | A1 | 6/2011 | Botzas | |
| 2011/0181630 | A1 | 7/2011 | Smith | |
| 2011/0199395 | A1 | 8/2011 | Nathan | |
| 2011/0227964 | A1 | 9/2011 | Chaji | |
| 2011/0273399 | A1 | 11/2011 | Lee | |
| 2011/0293480 | A1 | 12/2011 | Mueller | |
| 2012/0044232 | A1 | 2/2012 | Yamada | |
| 2012/0044272 | A1 | 2/2012 | Han | |
| 2012/0056558 | A1 | 3/2012 | Toshiya | |
| 2012/0062565 | A1 | 3/2012 | Fuchs | |
| 2012/0262184 | A1 | 10/2012 | Shen | |
| 2012/0299978 | A1 | 11/2012 | Chaji | |
| 2013/0027381 | A1 | 1/2013 | Nathan | |
| 2013/0057595 | A1 | 3/2013 | Nathan | |
| 2013/0112960 | A1 | 5/2013 | Chaji | |
| 2013/0135272 | A1 | 5/2013 | Park | |
| 2013/0309821 | A1 | 11/2013 | Yoo | |
| 2013/0321671 | A1 | 12/2013 | Cote | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1682267 | A | 10/2005 |
| CN | 1760945 | | 4/2006 |
| CN | 1886774 | | 12/2006 |
| CN | 102656621 | | 9/2012 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-145197 | | 5/2004 |
| JP | 2004-287345 | | 10/2004 |
| JP | 2005-057217 | | 3/2005 |
| JP | 2007-65015 | | 3/2007 |
| JP | 2007-163712 | A | 6/2007 |
| JP | 2008102335 | | 5/2008 |
| JP | 4-158570 | | 10/2008 |
| JP | 2009-265621 | A | 11/2009 |
| JP | 2013-506168 | A | 2/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |

(56) References Cited

FOREIGN PATENT DOCUMENTS

| | | | |
|---|---|---|---|
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A Novel Driving Scheme for High Resolution Large-area a-Si:H AMOLED displays"; dated Aug. 2005 (3 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated My 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report for Application No. EP 01 11 22313 dated Sep. 14, 2005 (4 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Search Report for Application No. PCT/CA2006/000177 dated Jun. 2, 2006.
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Fossum, Eric R.. "Active Pixel Sensors: Are CCD's Dinosaurs?" SPIE: Symposium on Electronic Imaging. Feb. 1, 1993 (13 pages).
Goh et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.

(56) References Cited

OTHER PUBLICATIONS

International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
International Written Opinion for Application No. PCT/IB2014/060879, Canadian Intellectual Property Office, dated Jul. 17, 2014; (4 pages).
Jafarabadiashtiani et al.: "A New Driving Method for a-Si AMOLED Displays Based on Voltage Feedback"; dated 2005 (4 pages).
Kanicki, J., et al. "Amorphous Silicon Thin-Film Transistors Based Active-Matrix Organic Light-Emitting Displays." Asia Display: International Display Workshops, Sep. 2001 (pp. 315-318).
Karim, K. S., et al. "Amorphous Silicon Active Pixel Sensor Readout Circuit for Digital Imaging." IEEE: Transactions on Electron Devices. vol. 50, No. 1, Jan. 2003 (pp. 200-208).
Lee et al.: "Ambipolar Thin-Film Transistors Fabricated by PECVD Nanoclystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Ma E Y et al.: "organic light emitting diode/thin film transistor integration for foldable displays" dated Sep. 15, 1997(4 pages).
Matsueda y et al.: "35.1: 2.5-in. AMOLED with Integrated 6-bit Gamma Compensated Digital Data Driver"; dated May 2004.
Mendes E., et al. "A High Resolution Switch-Current Memory Base Cell." IEEE: Circuits and Systems. vol. 2, Aug. 1999 (pp. 718-721).
Nathan A. et al., "Thin Film imaging technology on glass and plastic" ICM 2000, proceedings of the 12 international conference on microelectronics, dated Oct. 31, 2001 (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for active Matrix Organic Light Emitting Diode Displays,"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Office Action in Japanese patent application No. JP2006-527247 dated Mar. 15, 2010. (8 pages).
Office Action in Japanese patent application No. JP2007-545796 dated Sep. 5, 2011. (8 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Safavian et al.: "Three-TFT image sensor for real-time digital X-ray imaging"; dated Feb. 2, 2006 (2 pages).
Search Report for Taiwan Invention Patent Application No. 093128894 dated May 1, 2012. (1 page).
Search Report for Taiwan Invention Patent Application No. 94144535 dated Nov. 1, 2012. (1 page).
Singh, et al., "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler et al., System Considerations for RGBW OLED Displays, Journal of the SID 14/1, 2006, pp. 37-48.
Stewart M. et al., "polysilicon TFT technology for active matrix oled displays" IEEE transactions on electron devices, vol. 48, No. 5, dated May 2001 (7 pages).
Vygranenko et al.: "Stability of indium-oxide thin-film transistors by reactive ion beam assisted deposition"; dated 2009.

(56) References Cited

OTHER PUBLICATIONS

Wang et al.: "Indium oxides by reactive ion beam assisted evaporation: From material study to device application"; dated Mar. 2009 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
Written Opinion for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages) (w/English translation).
Japanese Office Action for Japanese Application No. 2012-551728, dated Jan. 6, 2015, with English language translation, 11 pages.

* cited by examiner

SYSTEM AND METHODS FOR EXTRACTING CORRELATION CURVES FOR AN ORGANIC LIGHT EMITTING DEVICE

CROSS-REFERENCE TO RELATED APPLICATIONS

The present application is a continuation-in-part of and claims priority to U.S. patent application Ser. No. 14/590,105, filed Jan. 6, 2015, which is a continuation-in-part of U.S. patent application Ser. No. 14/322,443, filed Jul. 2, 2014, which is a continuation-in-part of U.S. patent application Ser. No. 14/314,514, filed Jun. 25, 2014, which is a continuation-in-part of U.S. patent application Ser. No. 14/286,711, filed May 23, 2014, which is a continuation-in-part of U.S. patent application Ser. No. 14/027,811, filed Sep. 16, 2013, now allowed, which is a continuation of U.S. patent application Ser. No. 13/020,252, filed Feb. 3, 2011, now U.S. Pat. No. 8,589,100, which claims priority to Canadian Application No. 2,692,097, filed Feb. 4, 2010, and the present application also claims priority to Canadian Application No. 2,896,018, filed Jun. 30, 2015, Canadian Application No. 2,896,902, filed Jul. 13, 2015, U.S. Provisional Application No. 62/280,457, filed Jan. 19, 2016 and U.S. Provisional Application No. 62/280,498, filed Jan. 19, 2016, each of which is hereby incorporated by reference herein in its entirety.

FIELD OF THE INVENTION

This invention is directed generally to displays that use light emissive devices such as OLEDs and, more particularly, to extracting characterization correlation curves under different stress conditions in such displays to compensate for aging of the light emissive devices.

BACKGROUND

Active matrix organic light emitting device ("AMOLED") displays offer the advantages of lower power consumption, manufacturing flexibility, and faster refresh rate over conventional liquid crystal displays. In contrast to conventional liquid crystal displays, there is no backlighting in an AMOLED display as each pixel consists of different colored OLEDs emitting light independently. The OLEDs emit light based on current supplied through a drive transistor. The drive transistor is typically a thin film transistor (TFT). The power consumed in each pixel has a direct relation with the magnitude of the generated light in that pixel.

During operation of an organic light emitting diode device, it undergoes degradation, which causes light output at a constant current to decrease over time. The OLED device also undergoes an electrical degradation, which causes the current to drop at a constant bias voltage over time. These degradations are caused primarily by stress related to the magnitude and duration of the applied voltage on the OLED and the resulting current passing through the device. Such degradations are compounded by contributions from the environmental factors such as temperature, humidity, or presence of oxidants over time. The aging rate of the thin film transistor devices is also environmental and stress (bias) dependent. The aging of the drive transistor and the OLED may be properly determined via calibrating the pixel against stored historical data from the pixel at previous times to determine the aging effects on the pixel. Accurate aging data is therefore necessary throughout the lifetime of the display device.

In one compensation technique for OLED displays, the aging (and/or uniformity) of a panel of pixels is extracted and stored in lookup tables as raw or processed data. Then a compensation module uses the stored data to compensate for any shift in electrical and optical parameters of the OLED (e.g., the shift in the OLED operating voltage and the optical efficiency) and the backplane (e.g., the threshold voltage shift of the TFT), hence the programming voltage of each pixel is modified according to the stored data and the video content. The compensation module modifies the bias of the driving TFT in a way that the OLED passes enough current to maintain the same luminance level for each gray-scale level. In other words, a correct programming voltage properly offsets the electrical and optical aging of the OLED as well as the electrical degradation of the TFT.

The electrical parameters of the backplane TFTs and OLED devices are continuously monitored and extracted throughout the lifetime of the display by electrical feedback-based measurement circuits. Further, the optical aging parameters of the OLED devices are estimated from the OLED's electrical degradation data. However, the optical aging effect of the OLED is dependent on the stress conditions placed on individual pixels as well, and since the stresses vary from pixel to pixel, accurate compensation is not assured unless the compensation tailored for a specific stress level is determined.

There is therefore a need for efficient extraction of characterization correlation curves of the optical and electrical parameters that are accurate for stress conditions on active pixels for compensation for aging and other effects. There is also a need for having a variety of characterization correlation curves for a variety of stress conditions that the active pixels may be subjected to during operation of the display. There is a further need for accurate compensation systems for pixels in an organic light emitting device based display.

SUMMARY

In accordance with one aspect, there is provided a method of compensating for efficiency degradation of an organic light emitting device (OLED) in an array-based semiconductor device having arrays of pixels that include OLEDs, said method comprising: determining for a plurality of operating conditions interdependency curves relating changes in an electrical operating parameter of said OLEDs and the efficiency degradation of said OLEDs in said array-based semiconductor device, the plurality of operating conditions comprising at least two operating condition types; determining at least one operation condition for the OLED in respect of the at least two operating condition types; measuring the electrical operating parameter of said OLED; determining an efficiency degradation of said OLED using said interdependency curves, said at least one operation condition for the OLED, and said measured electrical operating parameter; determining a correction factor for the OLED with use of said efficiency degradation; and compensating for said efficiency degradation with use of said correction factor.

In some embodiments, the at least two operating condition types comprise a temperature condition and a stress condition, and the at least one operation condition for the OLED comprises a temperature history and a stress history.

In some embodiments, each interdependency curve has an associated temperature condition and a stress condition, and wherein determining an efficiency degradation comprises: determining at least one temperature associated interdependency curve with use of said temperature history; and determining from said at least one temperature associated interdependency curve and said stress history and said measured electrical operating parameter, the efficiency degradation of the OLED.

In some embodiments each interdependency curve has an associated effective stress history as a function of at least the temperature condition and a stress condition, and wherein determining an efficiency degradation comprises: determining an effective stress history for the OLED with use of the temperature history and the stress history; and determining from said interdependency curves and said effective stress history and said measured electrical operating parameter the efficiency degradation of the OLED.

In some embodiments, after the correction factor for the OLED has been determined, a start point associated with the interdependency curves is reset.

In some embodiments, the at least two operating condition types comprise a temperature condition and an initial device characteristic condition, and the at least one operation condition for the OLED comprises a temperature history and initial device characteristics.

In some embodiments, each interdependency curve has an associated initial device characteristic condition and a stress condition, and wherein determining an efficiency degradation comprises: determining at least one initial device characteristic associated interdependency curve with use of said initial device characteristics; and determining from said at least one initial device characteristic associated interdependency curve and said stress history and said measured electrical operating parameter, the efficiency degradation of the OLED.

In some embodiments, determining for a plurality of operating conditions interdependency curves comprises: extracting initial characteristics for each of a plurality of test OLEDs; repeatedly subjecting the test OLEDs to different stress conditions until all test OLEDs are measured; and extracting interdependency curves for said test OLEDs and storing said interdependency curves such that each interdependency curve is associated with at least one stress condition and an initial device characteristic condition.

Some embodiments further provide for updating remotely a set of interdependency curves stored with the array-based semiconductor device with a set of prepared interdependency curves from a remote interdependency curve library at least twice after fabrication of the array-based semiconductor device.

In some embodiments the updating remotely occurs at the time of at least two of: shipping the array-based semiconductor device to the manufacturer, integrating the array-based semiconductor device into a product, and operation of the array-based semiconductor device at a consumer site.

In some embodiments, determining the efficiency degradation comprises: initializing a total effective stress time value; sampling brightness data for said OLED; calculating an effective stress time corresponding to said sampling for at least one given reference stress level; updating the total effective stress time for said OLED based on the at least one given stress level; determining whether to sample more brightness data; and in a case no more brightness data are to be sampled, updating the efficiency degradation with use of the total effective stress, and the interdependency curves.

In some embodiments, determining whether to sample more brightness data comprises comparing the total effective stress time with a predetermined threshold.

In some embodiments, determining the efficiency degradation comprises: initializing a total change in degradation factor; sampling brightness data for said OLED; calculating a change in degradation corresponding to the sampled brightness; updating the total change in degradation factor for said OLED; determining whether to sample more brightness data; and in a case no more brightness data are to be sampled, updating the efficiency degradation with use of the total change in degradation factor, and the interdependency curves.

In some embodiments, determining whether to sample more brightness data comprises comparing the total change in degradation factor with a predetermined change in degradation threshold.

In accordance with another aspect, there is provided a method of compensating for efficiency degradation of an organic light emitting device (OLED) in an array-based semiconductor device having arrays of pixels that include OLEDs, said method comprising: determining for a plurality of operating conditions at least one degradation-time curve relating changes in a stress time parameter associated with said OLEDs and the efficiency degradation of said OLEDs in said array-based semiconductor device, the plurality of operating stress conditions comprising at least two operating stress condition types; measuring at least one operating stress condition for the OLED in respect of the at least two operating stress condition types; determining an efficiency degradation of said OLED using said at least one degradation-time curve, and said at least one operating stress condition for the OLED; determining a correction factor for the OLED with use of said efficiency degradation; and compensating for said efficiency degradation with use of said correction factor.

In some embodiments, after the correction factor for the OLED has been determined, a start point associated with the at least one degradation-time curve is reset.

In some embodiments, determining the efficiency degradation comprises: initializing a total effective stress time value; sampling brightness data for said OLED; calculating an effective stress time corresponding to said sampling for at least one given reference stress level; updating the total effective stress time for said OLED based on the at least one given stress level; determining whether to sample more brightness data; and in a case no more brightness data are to be sampled, updating the efficiency degradation with use of the total effective stress, and the at least one degradation-time curve.

In some embodiments, determining the efficiency degradation comprises: initializing a total change in degradation factor; sampling brightness data for said OLED; calculating a change in degradation corresponding to the sampled brightness; updating the total change in degradation factor for said OLED; determining whether to sample more brightness data; and in a case no more brightness data are to be sampled, updating the efficiency degradation with use of the total change in degradation factor, and the at least one degradation-time curve.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

Figure 1:
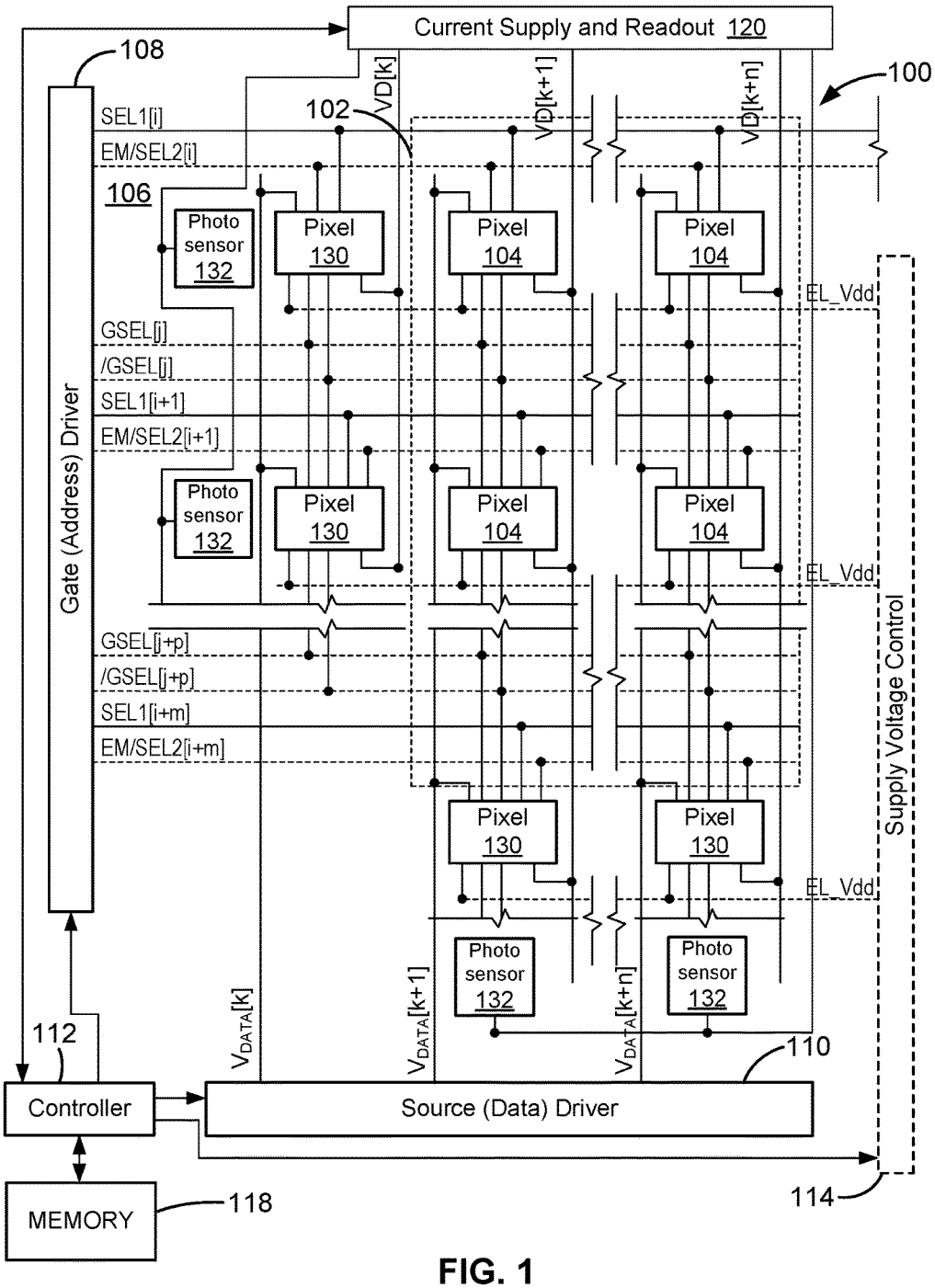
FIG. 1 is a block diagram of an AMOLED display system with compensation control.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is an electronic display system 100 having an active matrix area or pixel array 102 in which an array of active pixels 104 are arranged in a row and column configuration. For ease of illustration, only two rows and columns are shown. External to the active matrix area, which is the pixel array 102, is a peripheral area 106 where peripheral circuitry for driving and controlling the area of the pixel array 102 are disposed. The peripheral circuitry includes a gate or address driver circuit 108, a source or data driver circuit 110, a controller 112, and an optional supply voltage (e.g., EL_Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. In pixel sharing configurations described below, the gate or address driver circuit 108 can also optionally operate on global select lines GSEL[j] and optionally /GSEL[j], which operate on multiple rows of pixels 104 in the pixel array 102, such as every two rows of pixels 104. The source driver circuit 110, under control of the controller 112, operates on voltage data lines Vdata[k], Vdata[k+1], and so forth, one for each column of pixels 104 in the pixel array 102. The voltage data lines carry voltage programming information to each pixel 104 indicative of brightness of each light emitting device in the pixel 104. A storage element, such as a capacitor, in each pixel 104 stores the voltage programming information until an emission or driving cycle turns on the light emitting device. The optional supply voltage driver 114, under control of the controller 112, controls a supply voltage (EL_Vdd) line, one for each row of pixels 104 in the pixel array 102. The controller 112 is also coupled to a memory 118 that stores various characterization correlation curves and aging parameters of the pixels 104 as will be explained below. The memory 118 may be one or more of a flash memory, an SRAM, a DRAM, combinations thereof, and/or the like.

The display system 100 may also include a current source circuit, which supplies a fixed current on current bias lines. In some configurations, a reference current can be supplied to the current source circuit. In such configurations, a current source control controls the timing of the application of a bias current on the current bias lines. In configurations in which the reference current is not supplied to the current source circuit, a current source address driver controls the timing of the application of a bias current on the current bias lines.

As is known, each pixel 104 in the display system 100 needs to be programmed with information indicating the brightness of the light emitting device in the pixel 104. A frame defines the time period that includes a programming cycle or phase during which each and every pixel in the display system 100 is programmed with a programming voltage indicative of a brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all of the frames are driven row-by-row. Either scheme can employ a brief vertical blanking time at the beginning or end of each period during which the pixels are neither programmed nor driven.

The components located outside of the pixel array 102 may be disposed in a peripheral area 106 around the pixel array 102 on the same physical substrate on which the pixel array 102 is disposed. These components include the gate driver 108, the source driver 110, and the optional supply voltage control 114. Alternately, some of the components in the peripheral area can be disposed on the same substrate as the pixel array 102 while other components are disposed on a different substrate, or all of the components in the peripheral area can be disposed on a substrate different from the substrate on which the pixel array 102 is disposed. Together, the gate driver 108, the source driver 110, and the supply voltage control 114 make up a display driver circuit. The display driver circuit in some configurations may include the gate driver 108 and the source driver 110 but not the supply voltage control 114.

The display system 100 further includes a current supply and readout circuit 120, which reads output data from data output lines, VD [k], VD [k+1], and so forth, one for each column of active pixels 104 in the pixel array 102. A set of optional reference devices such as reference pixels 130 is fabricated on the edge of the pixel array 102 outside the active pixels 104 in the peripheral area 106. The reference pixels 130 also may receive input signals from the controller 112 and may output data signals to the current supply and readout circuit 120. The reference pixels 130 include the drive transistor and an OLED but are not part of the pixel array 102 that displays images. As will be explained below, different groups of reference pixels 130 are placed under different stress conditions via different current levels from the current supply circuit 120. Because the reference pixels 130 are not part of the pixel array 102 and thus do not display images, the reference pixels 130 may provide data indicating the effects of aging at different stress conditions. Although only one row and column of reference pixels 130 is shown in FIG. 1, it is to be understood that there may be any number of reference pixels. Each of the reference pixels 130 in the example shown in FIG. 1 are fabricated next to a corresponding photo sensor 132. The photo sensor 132 is used to determine the luminance level emitted by the corresponding reference pixel 130. It is to be understood that reference devices such as the reference pixels 130 may be a stand alone device rather than being fabricated on the display with the active pixels 104.

Figure 2:
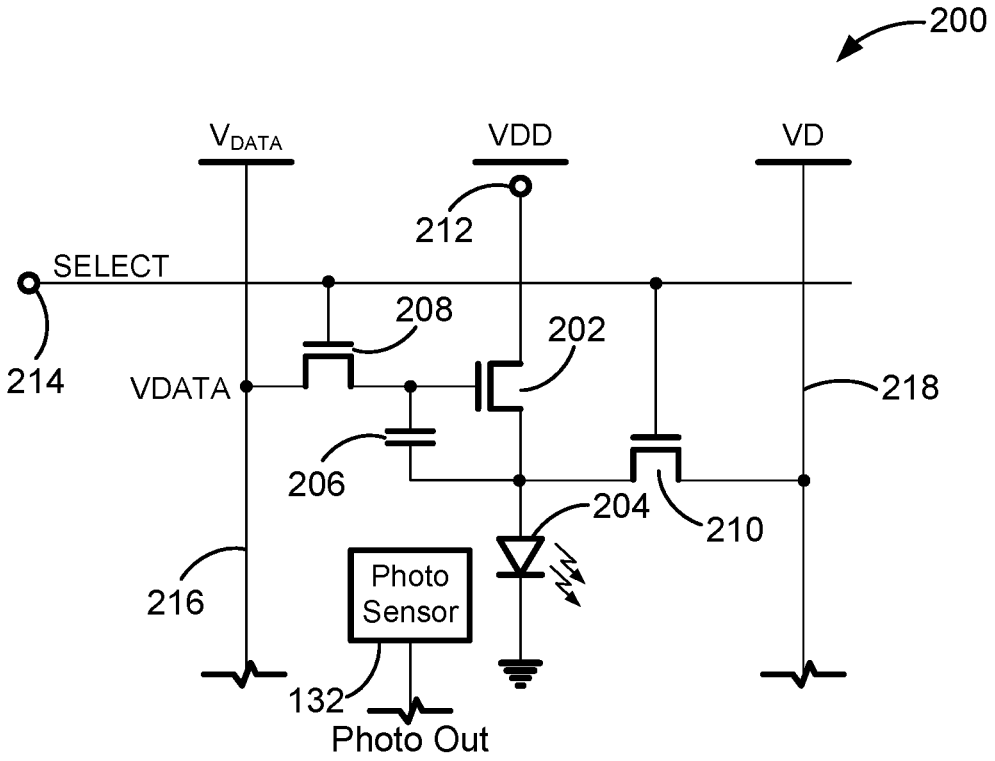
FIG. 2 is a circuit diagram of one of the reference pixels in FIG. 1 for modifying characterization correlation curves based on the measured data.

FIG. 2 shows one example of a driver circuit 200 for one of the example reference pixels 130 in FIG. 1. The driver circuit 200 of the reference pixel 130 includes a drive transistor 202, an organic light emitting device ("OLED") 204, a storage capacitor 206, a select transistor 208 and a monitoring transistor 210. A voltage source 212 is coupled to the drive transistor 202. As shown in FIG. 2, the drive transistor 202 is a thin film transistor in this example that is fabricated from amorphous silicon. A select line 214 is coupled to the select transistor 208 to activate the driver circuit 200. A voltage programming input line 216 allows a programming voltage to be applied to the drive transistor 202. A monitoring line 218 allows outputs of the OLED 204 and/or the drive transistor 202 to be monitored. The select line 214 is coupled to the select transistor 208 and the monitoring transistor 210. During the readout time, the select line 214 is pulled high. A programming voltage may be applied via the programming voltage input line 216. A monitoring voltage may be read from the monitoring line 218 that is coupled to the monitoring transistor 210. The signal to the select line 214 may be sent in parallel with the pixel programming cycle.

The reference pixel 130 may be stressed at a certain current level by applying a constant voltage to the programming voltage input line 216. As will be explained below, the voltage output measured from the monitoring line 218 based on a reference voltage applied to the programming voltage input line 216 allows the determination of electrical characterization data for the applied stress conditions over the time of operation of the reference pixel 130. Alternatively, the monitor line 218 and the programming voltage input line 216 may be merged into one line (i.e., Data/Mon) to carry out both the programming and monitoring functions through that single line. The output of the photo-sensor 132 allows the determination of optical characterization data for stress conditions over the time of operation for the reference pixel 130.

The display system 100 in FIG. 1, according to one exemplary embodiment, in which the brightness of each pixel (or subpixel) is adjusted based on the aging of at least one of the pixels, to maintain a substantially uniform display over the operating life of the system (e.g., 75,000 hours). Non-limiting examples of display devices incorporating the display system 100 include a mobile phone, a digital camera, a personal digital assistant (PDA), a computer, a television, a portable video player, a global positioning system (GPS), etc.

As the OLED material of an active pixel 104 ages, the voltage required to maintain a constant current for a given level through the OLED increases. To compensate for electrical aging of the OLEDs, the memory 118 stores the required compensation voltage of each active pixel to maintain a constant current. It also stores data in the form of characterization correlation curves for different stress conditions that is utilized by the controller 112 to determine compensation voltages to modify the programming voltages to drive each OLED of the active pixels 104 to correctly display a desired output level of luminance by increasing the OLED's current to compensate for the optical aging of the OLED. In particular, the memory 118 stores a plurality of predefined characterization correlation curves or functions, which represent the degradation in luminance efficiency for OLEDs operating under different predetermined stress conditions. The different predetermined stress conditions generally represent different types of stress or operating conditions that an active pixel 104 may undergo during the lifetime of the pixel. Different stress conditions may include constant current requirements at different levels from low to high, constant luminance requirements from low to high, or a mix of two or more stress levels. For example, the stress levels may be at a certain current for some percentage of the time and another current level for another percentage of the time. Other stress levels may be specialized such as a level representing an average streaming video displayed on the display system 100. Initially, the base line electrical and optical characteristics of the reference devices such as the reference pixels 130 at different stress conditions are stored in the memory 118. In this example, the baseline optical characteristic and the baseline electrical characteristic of the reference device are measured from the reference device immediately after fabrication of the reference device.

Each such stress condition may be applied to a group of reference pixels such as the reference pixels 130 by maintaining a constant current through the reference pixel 130 over a period of time, maintaining a constant luminance of the reference pixel 130 over a period of time, and/or varying the current through or luminance of the reference pixel at different predetermined levels and predetermined intervals over a period of time. The current or luminance level(s) generated in the reference pixel 130 can be, for example, high values, low values, and/or average values expected for the particular application for which the display system 100 is intended. For example, applications such as a computer monitor require high values. Similarly, the period(s) of time for which the current or luminance level(s) are generated in the reference pixel may depend on the particular application for which the display system 100 is intended.

It is contemplated that the different predetermined stress conditions are applied to different reference pixels 130 during the operation of the display system 100 in order to replicate aging effects under each of the predetermined stress conditions. In other words, a first predetermined stress condition is applied to a first set of reference pixels, a second predetermined stress condition is applied to a second set of reference pixels, and so on. In this example, the display system 100 has groups of reference pixels 130 that are stressed under 16 different stress conditions that range from a low current value to a high current value for the pixels. Thus, there are 16 different groups of reference pixels 130 in this example. Of course, greater or lesser numbers of stress conditions may be applied depending on factors such as the desired accuracy of the compensation, the physical space in the peripheral area 106, the amount of processing power available, and the amount of memory for storing the characterization correlation curve data.

By continually subjecting a reference pixel or group of reference pixels to a stress condition, the components of the reference pixel are aged according to the operating conditions of the stress condition. As the stress condition is applied to the reference pixel during the operation of the system 100, the electrical and optical characteristics of the reference pixel are measured and evaluated to determine data for determining correction curves for the compensation of aging in the active pixels 104 in the array 102. In this example, the optical characteristics and electrical characteristics are measured once an hour for each group of reference pixels 130. The corresponding characteristic correlation curves are therefore updated for the measured characteristics of the reference pixels 130. Of course, these measurements may be made in shorter periods of time or for longer periods of time depending on the accuracy desired for aging compensation.

Generally, the luminance of the OLED 204 has a direct linear relationship with the current applied to the OLED 204. The optical characteristic of an OLED may be expressed as:

$$L=O*I$$

In this equation, luminance, L, is a result of a coefficient, O, based on the properties of the OLED multiplied by the current I. As the OLED 204 ages, the coefficient O decreases and therefore the luminance decreases for a constant current value. The measured luminance at a given current may therefore be used to determine the characteristic change in the coefficient, O, due to aging for a particular OLED 204 at a particular time for a predetermined stress condition.

The measured electrical characteristic represents the relationship between the voltage provided to the drive transistor 202 and the resulting current through the OLED 204. For example, the change in voltage required to achieve a constant current level through the OLED of the reference pixel may be measured with a voltage sensor or thin film transistor such as the monitoring transistor 210 in FIG. 2. The required voltage generally increases as the OLED 204 and drive transistor 202 ages. The required voltage has a power law relation with the output current as shown in the following equation $$I=k*(V-e)^{a}$$

In this equation, the current is determined by a constant, k, multiplied by the input voltage, V, minus a coefficient, e, which represents the electrical characteristics of the drive transistor 202. The voltage therefore has a power law relation by the variable, a, to the current, I. As the transistor 202 ages, the coefficient, e, increases thereby requiring greater voltage to produce the same current. The measured current from the reference pixel may therefore be used to determine the value of the coefficient, e, for a particular reference pixel at a certain time for the stress condition applied to the reference pixel.

As explained above, the optical characteristic, O, represents the relationship between the luminance generated by the OLED 204 of the reference pixel 130 as measured by the photo sensor 132 and the current through the OLED 204 in FIG. 2. The measured electrical characteristic, e, represents the relationship between the voltage applied and the resulting current. The change in luminance of the reference pixel 130 at a constant current level from a baseline optical characteristic may be measured by a photo sensor such as the photo sensor 132 in FIG. 1 as the stress condition is applied to the reference pixel. The change in electric characteristics, e, from a baseline electrical characteristic may be measured from the monitoring line to determine the current output. During the operation of the display system 100, the stress condition current level is continuously applied to the reference pixel 130. When a measurement is desired, the stress condition current is removed and the select line 214 is activated. A reference voltage is applied and the resulting luminance level is taken from the output of the photo sensor 132 and the output voltage is measured from the monitoring line 218. The resulting data is compared with previous optical and electrical data to determine changes in current and luminance outputs for a particular stress condition from aging to update the characteristics of the reference pixel at the stress condition. The updated characteristics data is used to update the characteristic correlation curve.

Then by using the electrical and optical characteristics measured from the reference pixel, a characterization correlation curve (or function) is determined for the predetermined stress condition over time. The characterization correlation curve provides a quantifiable relationship between the optical degradation and the electrical aging expected for a given pixel operating under the stress condition. More particularly, each point on the characterization correlation curve determines the correlation between the electrical and optical characteristics of an OLED of a given pixel under the stress condition at a given time where measurements are taken from the reference pixel 130. The characteristics may then be used by the controller 112 to determine appropriate compensation voltages for active pixels 104 that have been aged under the same stress conditions as applied to the reference pixels 130. In another example, the baseline optical characteristic may be periodically measured from a base OLED device at the same time as the optical characteristic of the OLED of the reference pixel is being measured. The base OLED device either is not being stressed or being stressed on a known and controlled rate. This will eliminate any environmental effect on the reference OLED characterization.

Due to manufacturing processes and other factors known to those skilled in the art, each reference pixel 130 of the display system 100 may not have uniform characteristics, resulting in different emitting performances. One technique is to average the values for the electrical characteristics and the values of the luminance characteristics obtained by a set of reference pixels under a predetermined stress condition. A better representation of the effect of the stress condition on an average pixel is obtained by applying the stress condition to a set of the reference pixels 130 and applying a polling-averaging technique to avoid defects, measurement noise, and other issues that can arise during application of the stress condition to the reference pixels. For example, faulty values such as those determined due to noise or a dead reference pixel may be removed from the averaging. Such a technique may have predetermined levels of luminance and electrical characteristics that must be met before inclusion of those values in the averaging. Additional statistical regression techniques may also be utilized to provide less weight to electrical and optical characteristic values that are significantly different from the other measured values for the reference pixels under a given stress condition.

In this example, each of the stress conditions is applied to a different set of reference pixels. The optical and electrical characteristics of the reference pixels are measured, and a polling-averaging technique and/or a statistical regression technique are applied to determine different characterization correlation curves corresponding to each of the stress conditions. The different characterization correlation curves are stored in the memory 118. Although this example uses reference devices to determine the correlation curves, the correlation curves may be determined in other ways such as from historical data or predetermined by a manufacturer.

During the operation of the display system 100, each group of the reference pixels 130 may be subjected to the respective stress conditions and the characterization correlation curves initially stored in the memory 118 may be updated by the controller 112 to reflect data taken from the reference pixels 130 that are subject to the same external conditions as the active pixels 104. The characterization correlation curves may thus be tuned for each of the active pixels 104 based on measurements made for the electrical and luminance characteristics of the reference pixels 130 during operation of the display system 100. The electrical and luminance characteristics for each stress condition are therefore stored in the memory 118 and updated during the operation of the display system 100. The storage of the data may be in a piecewise linear model. In this example, such a piecewise linear model has 16 coefficients that are updated as the reference pixels 130 are measured for voltage and luminance characteristics. Alternatively, a curve may be determined and updated using linear regression or by storing data in a look up table in the memory 118.

To generate and store a characterization correlation curve for every possible stress condition would be impractical due to the large amount of resources (e.g., memory storage, processing power, etc.) that would be required. The disclosed display system 100 overcomes such limitations by determining and storing a discrete number of characterization correlation curves at predetermined stress conditions and subsequently combining those predefined characterization correlation curves using linear or nonlinear algorithm(s) to synthesize a compensation factor for each pixel 104 of the display system 100 depending on the particular operating condition of each pixel. As explained above, in this example there are a range of 16 different predetermined stress conditions and therefore 16 different characterization correlation curves stored in the memory 118.

For each pixel 104, the display system 100 analyzes the stress condition being applied to the pixel 104, and determines a compensation factor using an algorithm based on the predefined characterization correlation curves and the measured electrical aging of the panel pixels. The display system 100 then provides a voltage to the pixel based on the compensation factor. The controller 112 therefore determines the stress of a particular pixel 104 and determines the closest two predetermined stress conditions and attendant characteristic data obtained from the reference pixels 130 at those predetermined stress conditions for the stress condition of the particular pixel 104. The stress condition of the active pixel 104 therefore falls between a low predetermined stress condition and a high predetermined stress condition.

The following examples of linear and nonlinear equations for combining characterization correlation curves are described in terms of two such predefined characterization correlation curves for ease of disclosure; however, it is to be understood that any other number of predefined characterization correlation curves can be utilized in the exemplary techniques for combining the characterization correlation curves. The two exemplary characterization correlation curves include a first characterization correlation curve determined for a high stress condition and a second characterization correlation curve determined for a low stress condition.

Figure 3:
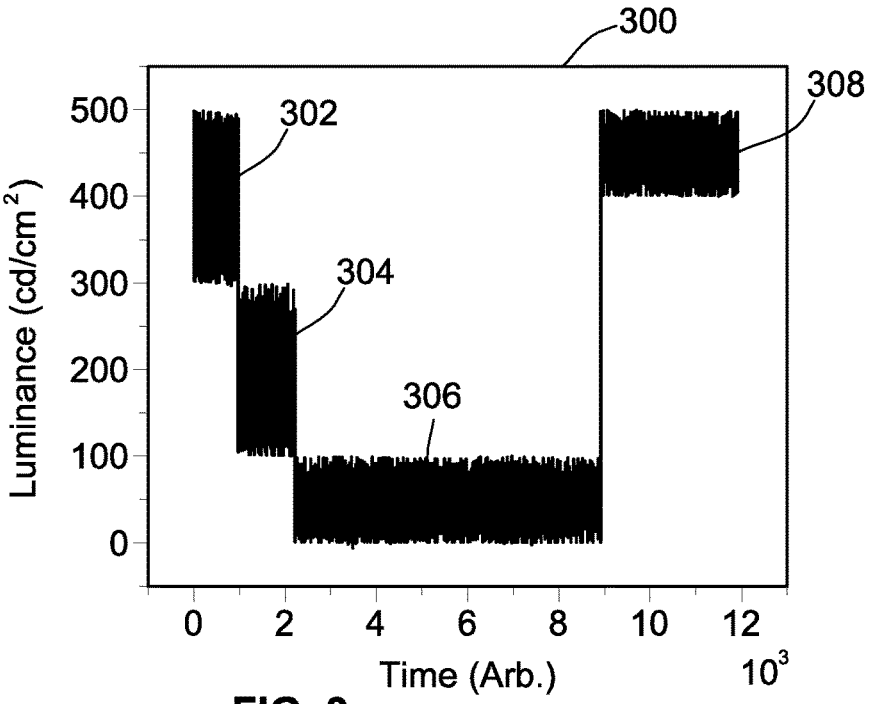
FIG. 3 is a graph of luminance emitted from an active pixel reflecting the different levels of stress conditions over time that may require different compensation.

The ability to use different characterization correlation curves over different levels provides accurate compensation for active pixels 104 that are subjected to different stress conditions than the predetermined stress conditions applied to the reference pixels 130. FIG. 3 is a graph showing different stress conditions over time for an active pixel 104 that shows luminance levels emitted over time. During a first time period, the luminance of the active pixel is represented by trace 302, which shows that the luminance is between 300 and 500 nits (cd/cm$^2$). The stress condition applied to the active pixel during the trace 302 is therefore relatively high. In a second time period, the luminance of the active pixel is represented by a trace 304, which shows that the luminance is between 300 and 100 nits. The stress condition during the trace 304 is therefore lower than that of the first time period and the age effects of the pixel during this time differ from the higher stress condition. In a third time period, the luminance of the active pixel is represented by a trace 306, which shows that the luminance is between 100 and 0 nits. The stress condition during this period is lower than that of the second period. In a fourth time period, the luminance of the active pixel is represented by a trace 308 showing a return to a higher stress condition based on a higher luminance between 400 and 500 nits.

The limited number of reference pixels 130 and corresponding limited numbers of stress conditions may require the use of averaging or continuous (moving) averaging for the specific stress condition of each active pixel 104. The specific stress conditions may be mapped for each pixel as a linear combination of characteristic correlation curves from several reference pixels 130. The combinations of two characteristic curves at predetermined stress conditions allow accurate compensation for all stress conditions occurring between such stress conditions. For example, the two reference characterization correlation curves for high and low stress conditions allow a close characterization correlation curve for an active pixel having a stress condition between the two reference curves to be determined. The first and second reference characterization correlation curves stored in the memory 118 are combined by the controller 112 using a weighted moving average algorithm. A stress condition at a certain time $St(t_i)$ for an active pixel may be represented by:

$$St(t_i)=(St(t_{i-1})*k_{avg}+L(t_i))/(k_{avg}+1)$$

In this equation, $St(t_{i-1})$ is the stress condition at a previous time, $k_{avg}$ is a moving average constant. $L(t_i)$ is the measured luminance of the active pixel at the certain time, which may be determined by:

$$L(t_i) = L_{peak}\left\{\frac{g(t_i)}{g_{peak}}\right\}^{\gamma}$$

In this equation, $L_{peak}$ is the highest luminance permitted by the design of the display system 100. The variable, $g(t_i)$ is the grayscale at the time of measurement, $g_{peak}$ is the highest grayscale value of use (e.g., 255) and is a gamma constant. A weighted moving average algorithm using the characterization correlation curves of the predetermined high and low stress conditions may determine the compensation factor, $K_{comp}$, via the following equation:

$$K_{comp}=K_{high}f_{high}(\Delta I)+K_{low}f_{low}(\Delta I)$$

In this equation, $f_{high}$ is the first function corresponding to the characterization correlation curve for a high predetermined stress condition and $f_{low}$ is the second function corresponding to the characterization correlation curve for a low predetermined stress condition. $\Delta I$ is the change in the current in the OLED for a fixed voltage input, which shows the change (electrical degradation) due to aging effects measured at a particular time. It is to be understood that the change in current may be replaced by a change in voltage, $\Delta V$, for a fixed current. $K_{high}$ is the weighted variable assigned to the characterization correlation curve for the high stress condition and $K_{low}$ is the weight assigned to the characterization correlation curve for the low stress condition. The weighted variables $K_{high}$ and $K_{low}$ may be determined from the following equations:

$$K_{high}=St(t_i)/L_{high}$$

$$K_{low}=1-K_{high}$$

Where $L_{high}$ is the luminance that was associated with the high stress condition.

The change in voltage or current in the active pixel at any time during operation represents the electrical characteristic while the change in current as part of the function for the high or low stress condition represents the optical characteristic. In this example, the luminance at the high stress condition, the peak luminance, and the average compensation factor (function of difference between the two characterization correlation curves), $K_{avg}$, are stored in the memory 118 for determining the compensation factors for each of the active pixels. Additional variables are stored in the memory 118 including, but not limited to, the grayscale value for the maximum luminance permitted for the display system 100 (e.g., grayscale value of 255). Additionally, the average compensation factor, $K_{avg}$, may be empirically determined from the data obtained during the application of stress conditions to the reference pixels.

As such, the relationship between the optical degradation and the electrical aging of any pixel 104 in the display system 100 may be tuned to avoid errors associated with divergence in the characterization correlation curves due to different stress conditions. The number of characterization correlation curves stored may also be minimized to a number providing confidence that the averaging technique will be sufficiently accurate for required compensation levels.

The compensation factor, $K_{comp}$ can be used for compensation of the OLED optical efficiency aging for adjusting programming voltages for the active pixel. Another technique for determining the appropriate compensation factor for a stress condition on an active pixel may be termed dynamic moving averaging. The dynamic moving averaging technique involves changing the moving average coefficient, $K_{avg}$, during the lifetime of the display system 100 to compensate between the divergence in two characterization correlation curves at different predetermined stress conditions in order to prevent distortions in the display output. As the OLEDs of the active pixels age, the divergence between two characterization correlation curves at different stress conditions increases. Thus, $K_{avg}$ may be increased during the lifetime of the display system 100 to avoid a sharp transition between the two curves for an active pixel having a stress condition falling between the two predetermined stress conditions. The measured change in current, may be used to adjust the $K_{avg}$ value to improve the performance of the algorithm to determine the compensation factor.

Another technique to improve performance of the compensation process termed event-based moving averaging is to reset the system after each aging step. This technique further improves the extraction of the characterization correlation curves for the OLEDs of each of the active pixels 104. The display system 100 is reset after every aging step (or after a user turns on or off the display system 100). In this example, the compensation factor, $K_{comp}$ is determined by $$K_{comp}=K_{comp_evt}+K_{high}(f_{high}(\Delta I)-f_{high}(\Delta I_{evt}))+K_{low}(f_{low}(\Delta I)-f_{low}(\Delta I_{evt}))$$

In this equation, $K_{comp_evt}$ is the compensation factor calculated at a previous time, and $_{evt}$ is the change in the OLED current during the previous time at a fixed voltage. As with the other compensation determination technique, the change in current may be replaced with the change in an OLED voltage change under a fixed current.

Figure 4:
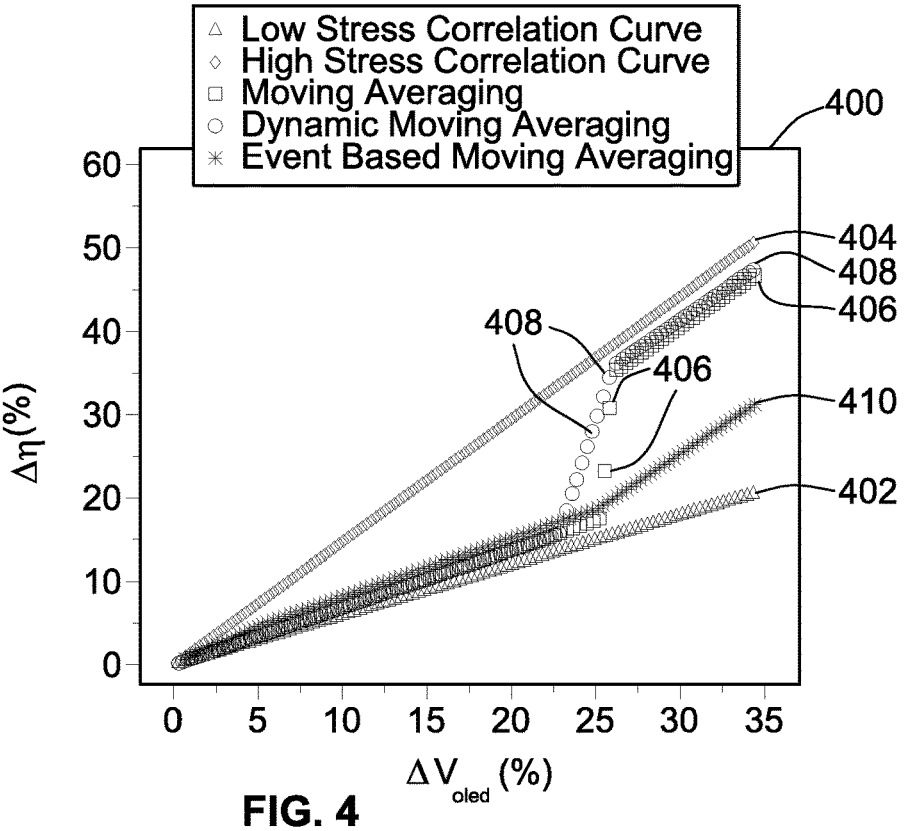
FIG. 4 is a graph of the plots of different characterization correlation curves and the results of techniques of using predetermined stress conditions to determine compensation.

FIG. 4 is a graph 400 showing the different characterization correlation curves based on the different techniques. The graph 400 compares the change in the optical compensation percent and the change in the voltage of the OLED of the active pixel required to produce a given current. As shown in the graph 400, a high stress predetermined characterization correlation curve 402 diverges from a low stress predetermined characterization correlation curve 404 at greater changes in voltage reflecting aging of an active pixel.

A set of points 406 represents the correction curve determined by the moving average technique from the predetermined characterization correlation curves 402 and 404 for the current compensation of an active pixel at different changes in voltage. As the change in voltage increases reflecting aging, the transition of the correction curve 406 has a sharp transition between the low characterization correlation curve 404 and the high characterization correlation curve 402. A set of points 408 represents the characterization correlation curve determined by the dynamic moving averaging technique. A set of points 410 represents the compensation factors determined by the event-based moving averaging technique. Based on OLED behavior, one of the above techniques can be used to improve the compensation for OLED efficiency degradation.

As explained above, an electrical characteristic of a first set of sample pixels is measured. For example, the electrical characteristic of each of the first set of sample pixels can be measured by a thin film transistor (TFT) connected to each pixel. Alternatively, for example, an optical characteristic (e.g., luminance) can be measured by a photo sensor provided to each of the first set of sample pixels. The amount of change required in the brightness of each pixel can be extracted from the shift in voltage of one or more of the pixels. This may be implemented by a series of calculations to determine the correlation between shifts in the voltage or current supplied to a pixel and/or the brightness of the light-emitting material in that pixel.

The above described methods of extracting characteristic correlation curves for compensating aging of the pixels in the array may be performed by a processing device such as the controller 112 in FIG. 1 or another such device, which may be conveniently implemented using one or more general purpose computer systems, microprocessors, digital signal processors, micro-controllers, application specific integrated circuits (ASIC), programmable logic devices (PLD), field programmable logic devices (FPLD), field programmable gate arrays (FPGA) and the like, programmed according to the teachings as described and illustrated herein, as will be appreciated by those skilled in the computer, software, and networking arts.

In addition, two or more computing systems or devices may be substituted for any one of the controllers described herein. Accordingly, principles and advantages of distributed processing, such as redundancy, replication, and the like, also can be implemented, as desired, to increase the robustness and performance of controllers described herein.

The operation of the example characteristic correlation curves for compensating aging methods may be performed by machine readable instructions. In these examples, the machine readable instructions comprise an algorithm for execution by: (a) a processor, (b) a controller, and/or (c) one or more other suitable processing device(s). The algorithm may be embodied in software stored on tangible media such as, for example, a flash memory, a CD-ROM, a floppy disk, a hard drive, a digital video (versatile) disk (DVD), or other memory devices, but persons of ordinary skill in the art will readily appreciate that the entire algorithm and/or parts thereof could alternatively be executed by a device other than a processor and/or embodied in firmware or dedicated hardware in a well-known manner (e.g., it may be implemented by an application specific integrated circuit (ASIC), a programmable logic device (PLD), a field programmable logic device (FPLD), a field programmable gate array (FPGA), discrete logic, etc.). For example, any or all of the components of the characteristic correlation curves for compensating aging methods could be implemented by software, hardware, and/or firmware. Also, some or all of the machine readable instructions represented may be implemented manually.

Figure 5:
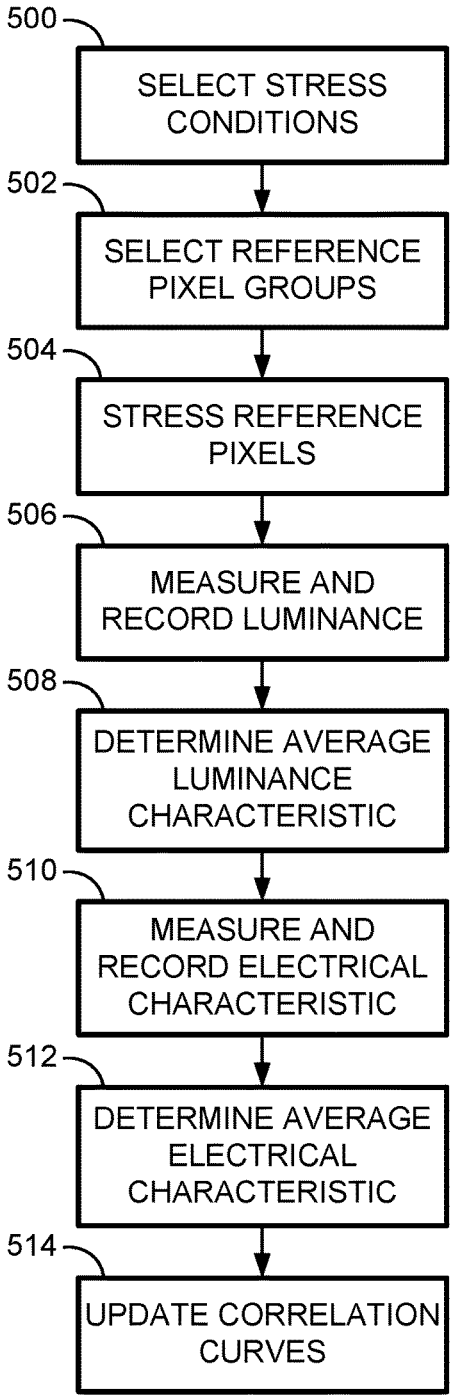
FIG. 5 is a flow diagram of the process of determining and updating characterization correlation curves based on groups of reference pixels under predetermined stress conditions.

FIG. 5 is a flow diagram of a process to determine and update the characterization correlation curves for a display system such as the display system 100 in FIG. 1. A selection of stress conditions is made to provide sufficient baselines for correlating the range of stress conditions for the active pixels (500). A group of reference pixels is then selected for each of the stress conditions (502). The reference pixels for each of the groups corresponding to each of the stress conditions are then stressed at the corresponding stress condition and base line optical and electrical characteristics are stored (504). At periodic intervals the luminance levels are measured and recorded for each pixel in each of the groups (506). The luminance characteristic is then determined by averaging the measured luminance for each pixel in the group of the pixels for each of the stress conditions (508). The electrical characteristics for each of the pixels in each of the groups are determined (510). The average of each pixel in the group is determined to determine the average electrical characteristic (512). The average luminance characteristic and the average electrical characteristic for each group are then used to update the characterization correlation curve for the corresponding predetermined stress condition (514). Once the correlation curves are determined and updated, the controller may use the updated characterization correlation curves to compensate for aging effects for active pixels subjected to different stress conditions.

Figure 6:
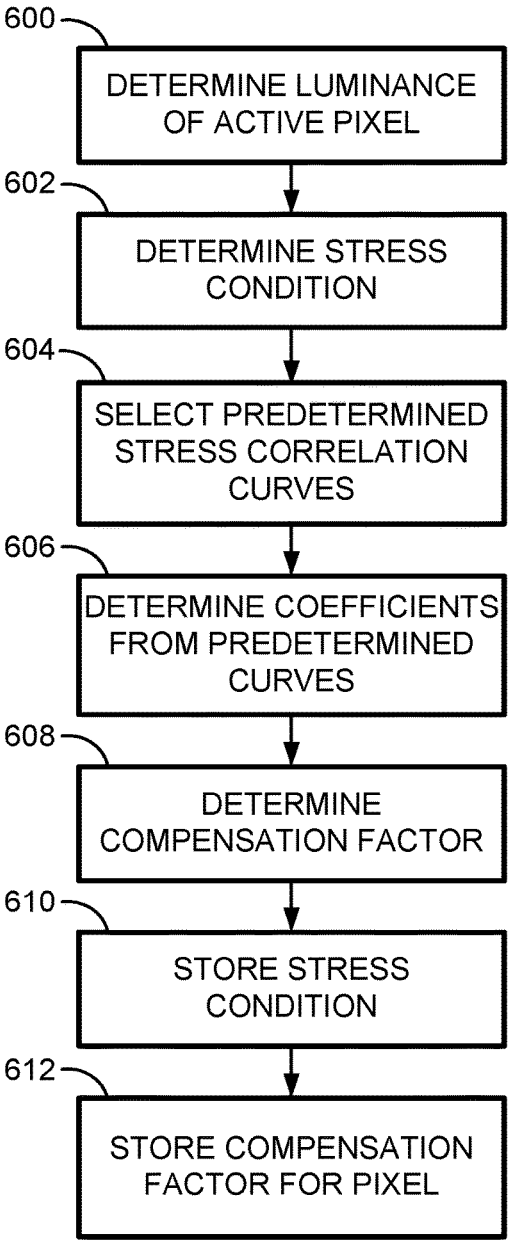
FIG. 6 is a flow diagram of the process of compensating the programming voltages of active pixels on a display using predetermined characterization correlation curves.

Referring to FIG. 6, a flowchart is illustrated for a process of using appropriate predetermined characterization correlation curves for a display system 100 as obtained in the process in FIG. 5 to determine the compensation factor for an active pixel at a given time. The luminance emitted by the active pixel is determined based on the highest luminance and the programming voltage (600). A stress condition is measured for a particular active pixel based on the previous stress condition, determined luminance, and the average compensation factor (602). The appropriate predetermined stress characterization correlation curves are read from memory (604). In this example, the two characterization correlation curves correspond to predetermined stress conditions that the measured stress condition of the active pixel falls between. The controller 112 then determines the coefficients from each of the predetermined stress conditions by using the measured current or voltage change from the active pixel (606). The controller then determines a modified coefficient to calculate a compensation voltage to add to the programming voltage to the active pixels (608). The determined stress condition is stored in the memory (610). The controller 112 then stores the new compensation factor, which may then be applied to modify the programming voltages to the active pixel during each frame period after the measurements of the reference pixels 130 (612).

Figure 7:
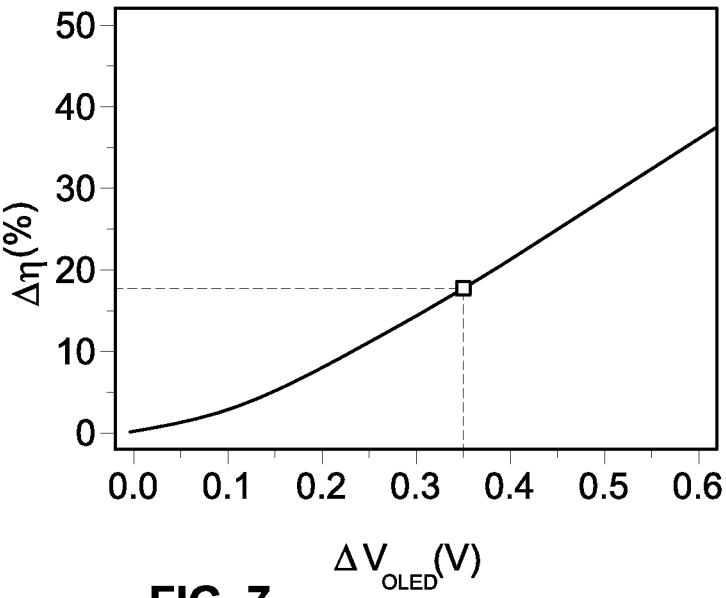
FIG. 7 is an interdependency curve of OLED efficiency degradation versus changes in OLED voltage.

OLED efficiency degradation can be calculated based on an interdependency curve based on OLED electrical changes versus efficiency degradation, such as the interdependency curve in FIG. 7. Here, the change in the OLED electrical parameter is detected, and that value is used to extract the efficiency degradation from the curve. The pixel current can then be adjusted accordingly to compensate for the degradation. The main challenge is that the interdependency curve is a function of stress conditions. Therefore, to achieve more accurate compensation, one needs to consider the effect of different stress conditions. One method is to use the stress condition of each pixel (or a group of pixels) to select from among different interdependency curves, to extract the proper efficiency lost for each specific case. Several methods of determining the stress condition will now be described.

Figure 8:
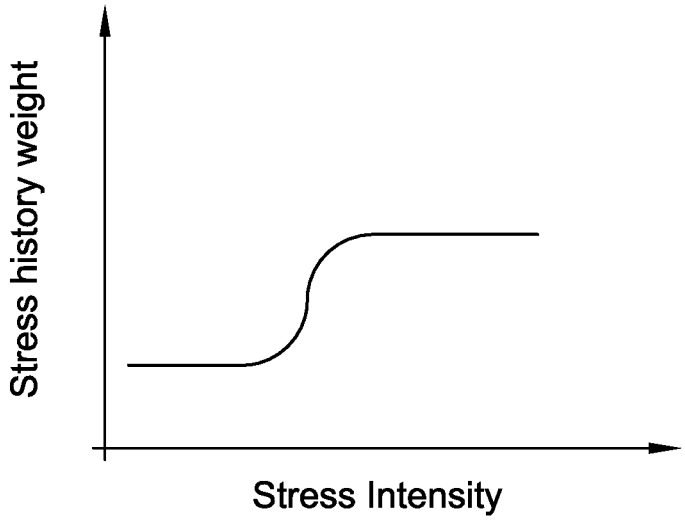
FIG. 8 is a graph of OLED stress history versus stress intensity.

First, one can create a stress history for each pixel (or group of pixels). The stress history can be simply a moving average of the stress conditions. To improve the calculation accuracy, a weighted stress history can be used. Here, the effect of each stress can have a different weight based on stress intensity or period, as in the example depicted in FIG. 8. For example, the effect of low intensity stress is less on selecting the OLED interdependency curve. Therefore, a curve that has lower weight for small intensity can be used, such as the curve in FIG. 8. Sub-sampling can also be used to calculate the stress history, to reduce the memory transfer activities. In one case, one can assume the stress history is low frequency in time. In this case, there is no need to sample the pixel conditions for every frame. The sampling rate can be modified for different applications based on content frame rate. Here, during every frame only a few pixels can be selected to obtain an updated stress history.

In another case, one can assume the stress history is low frequency in space. In this case, there is no need to sample all the pixels. Here, a sub-set of pixels are used to calculate the stress history, and then an interpolation technique can be used to calculate the stress history for all the pixels.

In another case, one can combine both low sampling rates in time and space.

Figure 9A:
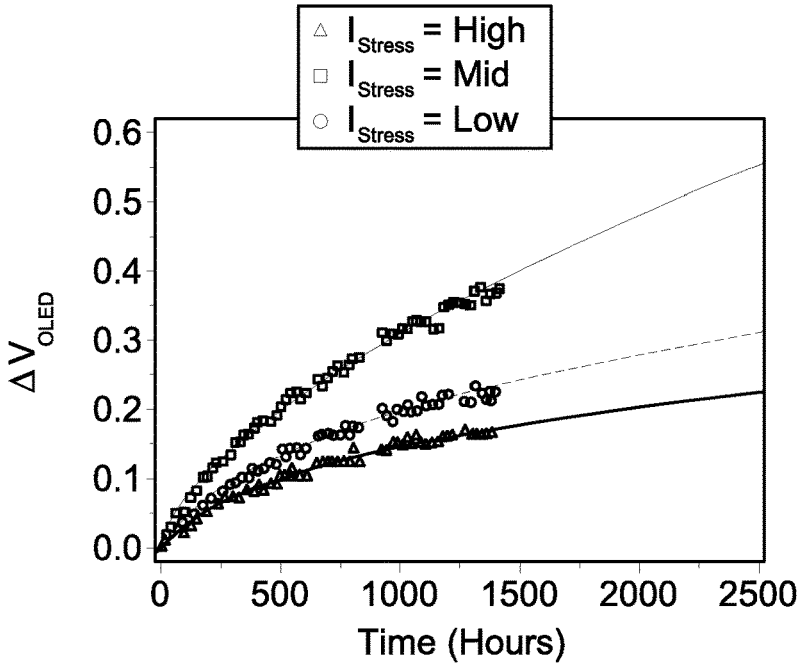
FIG. 9A is a graph of change in OLED voltage versus time for different stress conditions.
Figure 9B:
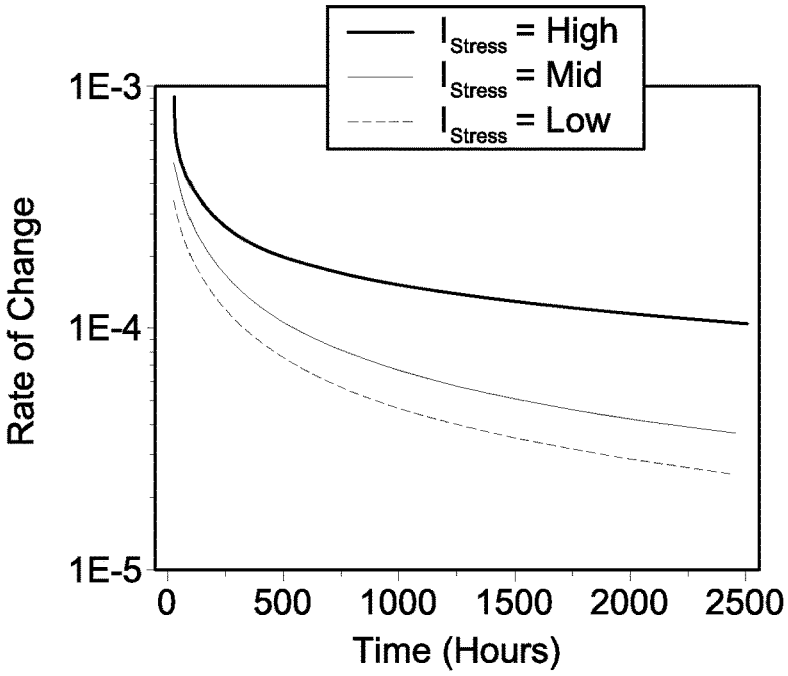
FIG. 9B is a graph of rate of change of OLED voltage versus time for different stress conditions.

In some cases, including the memory and calculation block required for stress history may not be possible. Here, the rate of change in the OLED electrical parameter can be used to extract the stress conditions, as depicted in FIGS. 9A and 9B. FIG. 9A illustrates the change of $\Delta V_{OLED}$ with time, for low, medium and high stress conditions, and FIG. 9B illustrates the rate of change versus time for the same three stress conditions.

Figure 10:
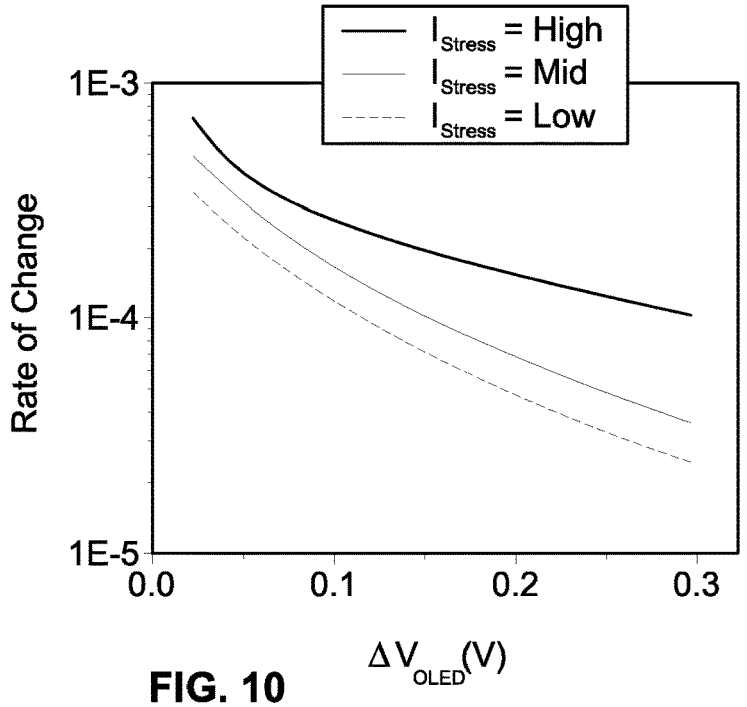
FIG. 10 is a graph of rate of change of OLED voltage versus change in OLED voltage, for different stress conditions.

As illustrated in FIG. 10, the rate of change in the electrical parameter can be used as an indicator of stress conditions. For example, the rate of change in the electrical parameter based on the change in the electrical parameter may be modeled or experimentally extracted for different stress conditions, as depicted in FIG. 10. The rate of change may also be used to extract the stress condition based on comparing the measured change and rate of change in the electrical parameter. Here, the function developed for change and rate of change of the electrical parameter is used. Alternatively, the stress condition, interdependency curves, and measured changed parameter may be used.

Figure 11:
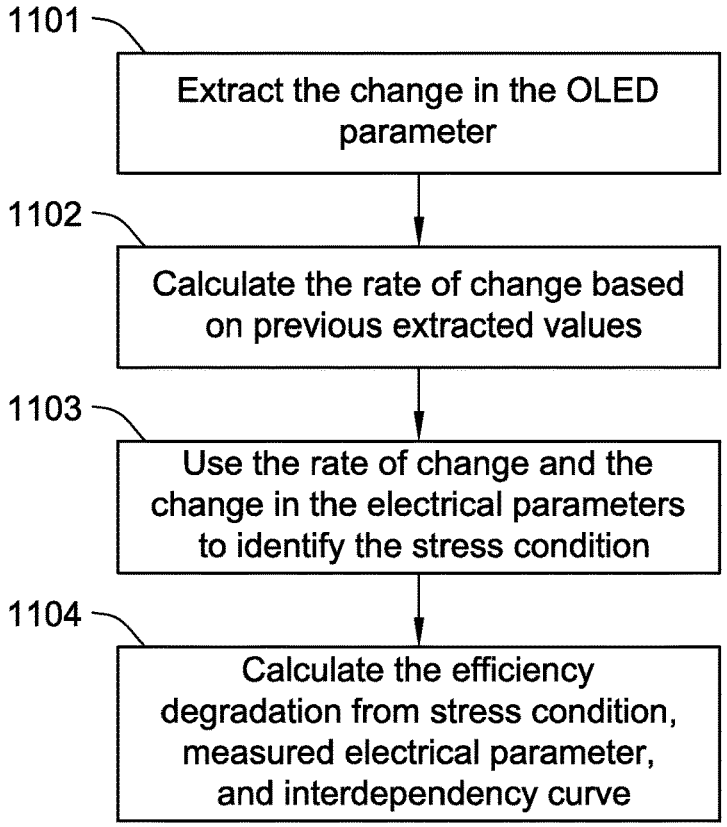
FIG. 11 is a flow chart of a procedure for extracting OLED efficiency degradation from changes in an OLED parameter such as OLED voltage.

FIG. 11 is a flow chart of a procedure for compensating the OLED efficiency degradation based on measuring the change and rate of change in the electrical parameter of the OLED. In this procedure, the change in the OLED parameter (e.g., OLED voltage) is extracted in step 1101, and then the rate of change in the OLED parameter, based on previously extracted values, is calculated in step 1102. Step 1103 then uses the rate of change and the change in the parameter to identify the stress condition. Finally, step 1104 calculates the efficiency degradation from the stress condition, the measured parameter, and interdependency curves.

Figure 12:
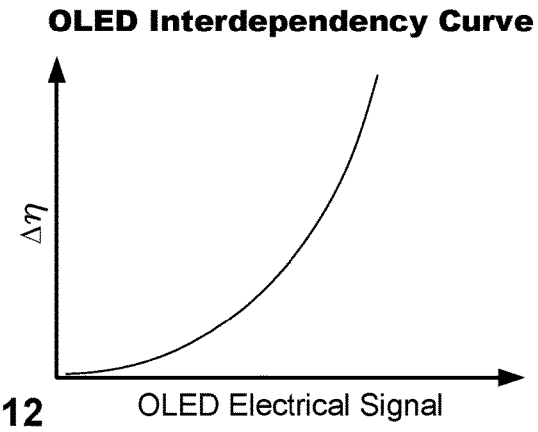
FIG. 12 is an OLED interdependency curve relating an OLED electrical signal and efficiency degradation.

One can compensate for OLED efficiency degradation using interdependency curves relating OLED electrical change (current or voltage) and efficiency degradation, as depicted in FIG. 12. Due to process variations, the interdependency curve may vary. In one example, a test OLED can be used in each display and the curve extracted for each display after fabrication or during the display operation. In the case of smaller displays, the test OLED devices can be put on the substrates and used to extract the curves after fabrication.

Figure 13:
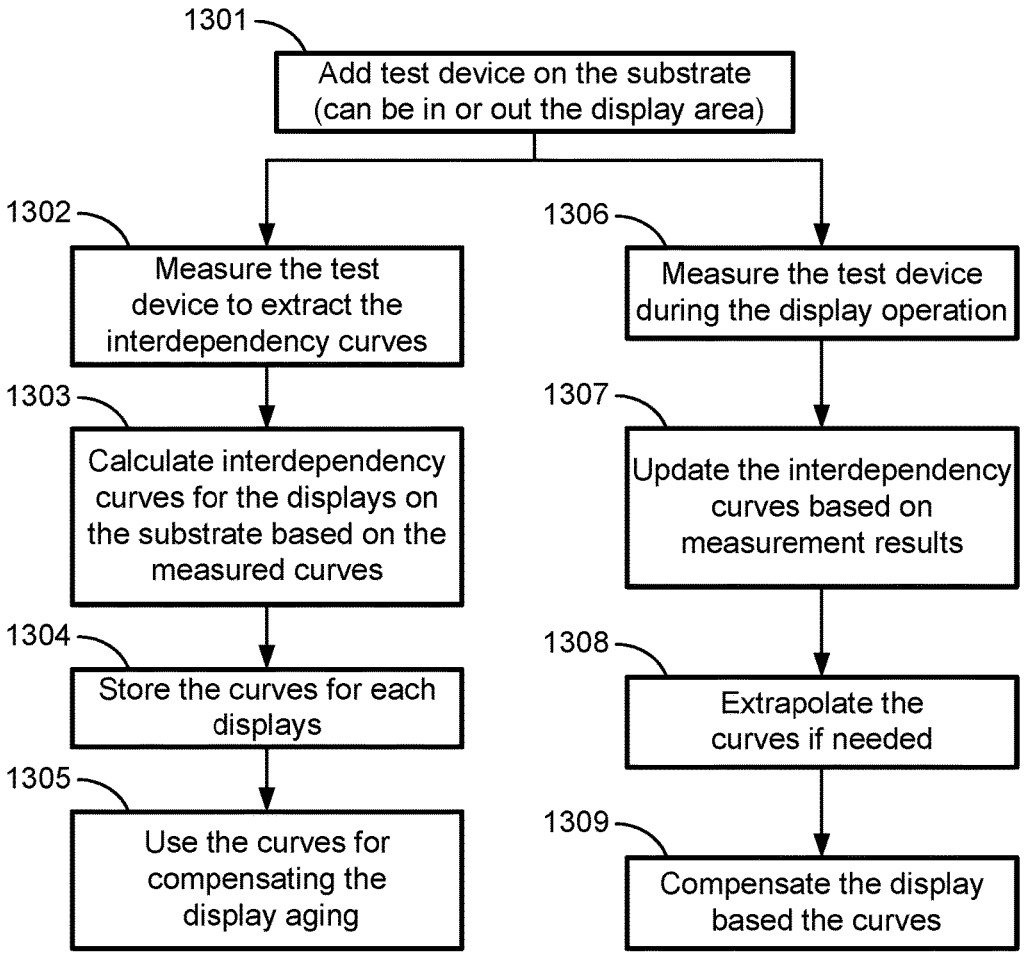
FIG. 13 is a flow chart of a procedure for extracting interdependency curves from test devices.

FIG. 13 is a flow chart of a process for extracting the interdependency curves from the test devices, either off line or during the display operation, or a combination of both. In this case, the curves extracted in the factory are stored for aging compensation. During the display operation, the curve can be updated with additional data based on measurement results of the test device in the display. However, since extraction may take time, a set of curves may measured in advance and put in the library. Here, the test devices are aged at predetermined aging levels (generally higher than normal) to extract some aging behavior in a short time period (and/or their current-voltage-luminance, IVL, is measured). After that, the extracted aging behavior is used to find a proper curve, having a similar or close aging behavior, from the library of curves.

In FIG. 13, the first step 1301 adds the test device on the substrate, in or out of the display area. Then step 1302 measures the test device to extract the interdependency curves. Step 1303 calculates the interdependency curves for the displays on the substrate, based on the measured curves. The curves are stored for each display in step 1304, and then used for compensating the display aging in step 1305. Alternatively, the test devices can be measured during the display operation at step 1306. Step 1307 then updates the interdependence curves based on the measured results. Step 1308 extrapolates the curves if needed, and step 1309 compensates the display based on the curves.

The following are some examples of procedures for finding a proper curve from a library:

(1) Choose the one with closest aging behavior (and/or IVL characteristic).

(2) Use the samples in the library with the closer behavior to the test sample and create a curve for the display. Here, weighted averaging can be used in which the weight of each curve is determined based on the error between their aging behaviors.

(3) If the error between the closet set of curves in the library and the test device is higher than a predetermined threshold, the test device can be used to create new curves and add them to the library.

Figure 14:
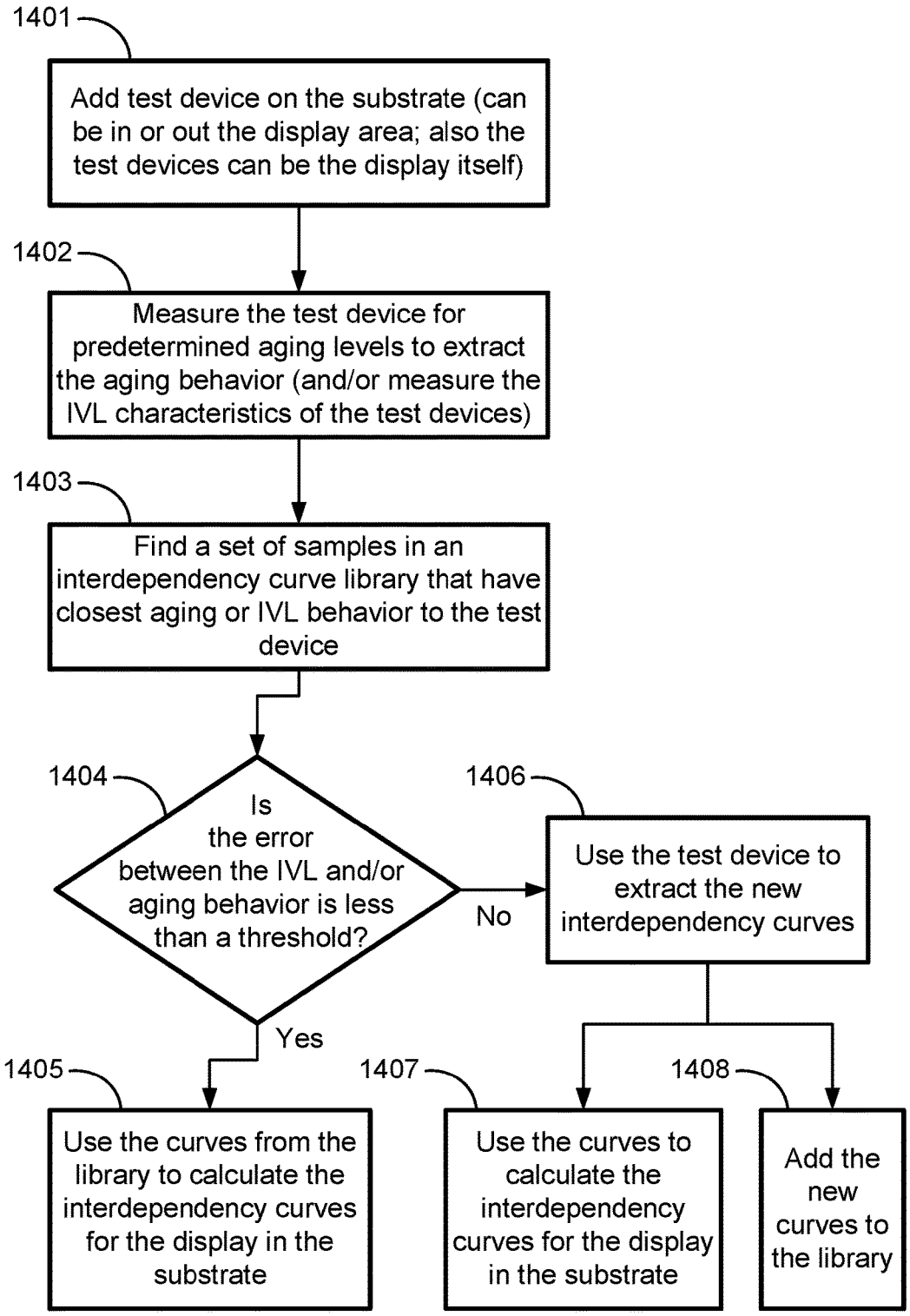
FIG. 14 is a flow chart of a procedure for calculating interdependency curves from a library.

FIG. 14 is a flow chart of a procedure for addressing the process variation between substrates or within a substrate. The first step 1401 adds a test device on the substrate, either in or out of the display area, or the test device can be the display itself. Step 1402 then measures the test device for predetermined aging levels to extract the aging behavior and/or measures the IVL characteristics of the test devices. Step 1403 finds a set of samples in an interdependency curve library that have the closest aging or IVL behavior to the test device. Then step 1404 determines whether the error between the IVL and/or aging behavior is less than a threshold. If the answer is affirmative, step 1405 uses the curves from the library to calculate the interdependency curves for the display in the substrate. If the answer at step 1404 is negative, step 1406 uses the test device to extract the new interdependency curves. Then the curves are used to calculate the interdependency curves for the display in the substrate in step 1407, and step 1408 adds the new curves to the library.

Semiconductor devices (e.g., OLEDs) may age differently under different ambient conditions (e.g., temperature, illumination, etc.) in addition to stress conditions. Moreover, some rare stress conditions may push the devices into aging conditions that are different from normal conditions. For example, an extremely high stress condition may damage the device physically (e.g., affecting contacts or other layers). In this case, identifying a compensation curve may require additional information, which can be obtained from the other devices in the pixel (e.g., transistors or sensors), from rates of change in the device characteristics (e.g., threshold voltage shift or mobility change), or by using the change in a multiple-device parameter to identify the stress conditions. In the case of using other devices, the rate of change in the other device parameters and/or the rate (or the absolute value) of change in the other-device parameter compared with the rate (or the absolute value) of change in the device parameter can be used to identify the aging condition. For example, at higher temperature, the TFT and the OLED become faster and so the rate of change can be an indicator of the temperature variation at which a TFT or an OLED is aged.

Figure 15B:
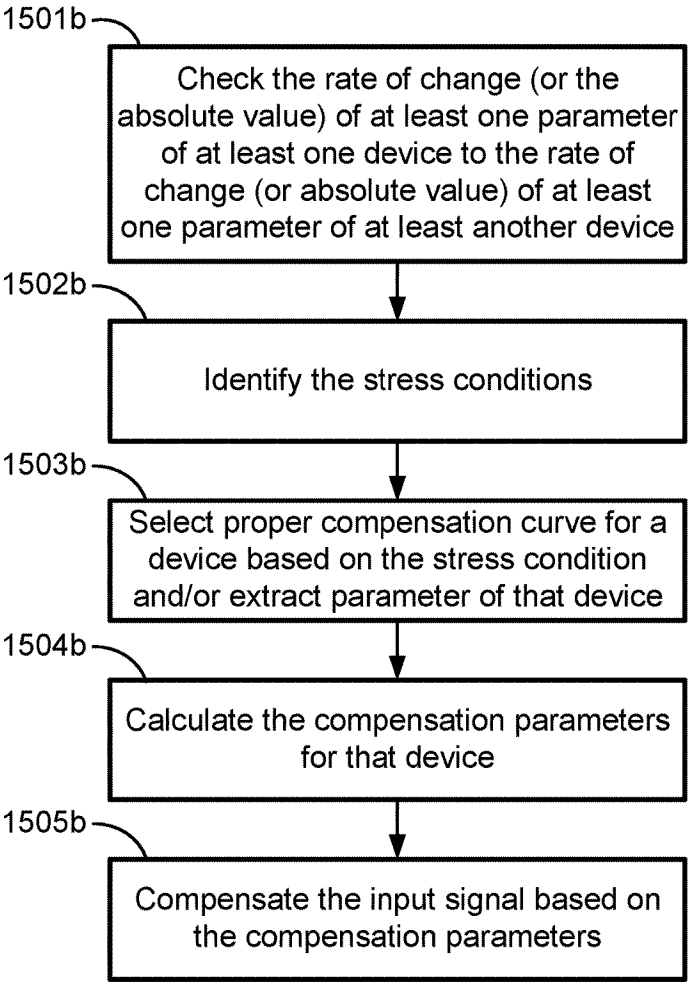
FIG. 15B is a flow chart of a procedure for identifying the stress condition of a device based on the rate of change or absolute value of a parameter of the device and the rate of change or absolute value of a parameter of another device.
Figure 15A:
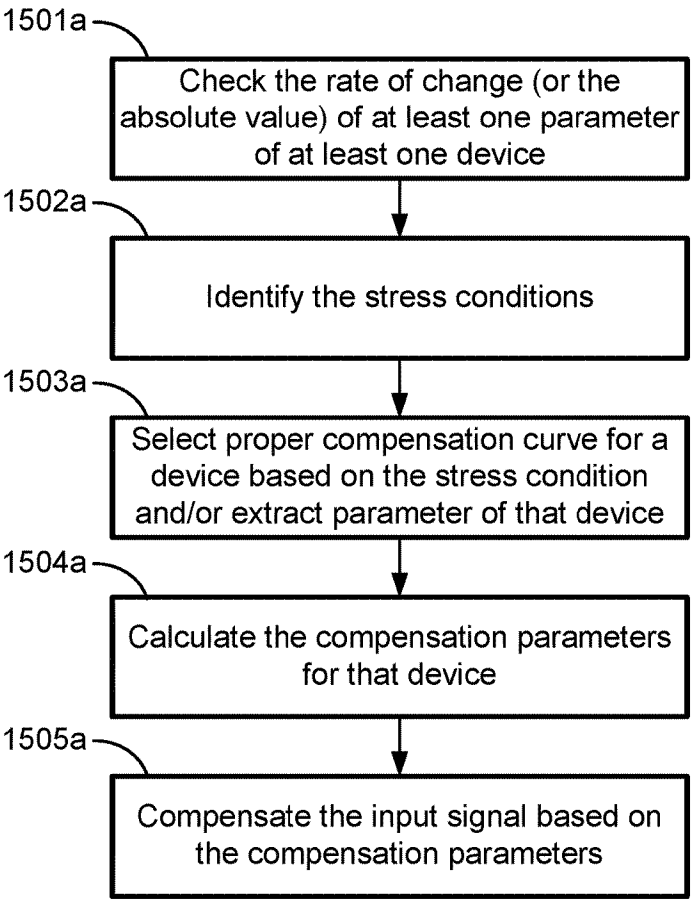
FIG. 15A is a flow chart of a procedure for identifying the stress condition of a device based on the rate of change or absolute value of a parameter of the device.

FIGS. 15A and 15B are flow charts that illustrate procedures for identifying the stress conditions for a device based on either the rate of change or absolute value of at least one parameter of at least one device, or on a comparison of the rate of change or absolute value of at least one parameter of at least one device to the rate of change or absolute value of at least one parameter of at least one other device. The identified stress conditions are used to select a proper compensation curve based on the identified stress conditions and/or extract a parameter of the device. The selected compensation curve is used to calculate compensation parameters for the device, and the input signal is compensated based on the calculated compensation parameters.

In FIG. 15A, the first step 1501*a* checks the rate of change or absolute value of at least one parameter of at least one device, such as an OLED, and then step 1502*a* identifies the stress conditions from that rate of change or absolute value. Step 1503*a* then selects the proper compensation curve for a device based on an identified stress condition and/or extracts a parameter of that device. The selected compensation curve is used at step 1504*a* to calculate compensation parameters for that device, and then step 1505*a* compensates the input signal based on the calculated compensation parameters.

In FIG. 15B, the first step 1501*b* compares the rate of change or absolute value of at least one parameter of at least one device, such as an OLED, to the rate of change or absolute value of at least one parameter of at least one other device. Step 1502*b* then identifies the stress conditions from that comparison, and step 1503*b* selects the proper compensation curve for a device based on an identified stress condition and/or extracts a parameter of that device. The selected compensation curve is used at step 1504*b* to calculate compensation parameters for that device, and then step 1505*b* compensates the input signal based on the calculated compensation parameters.

Figure 16:
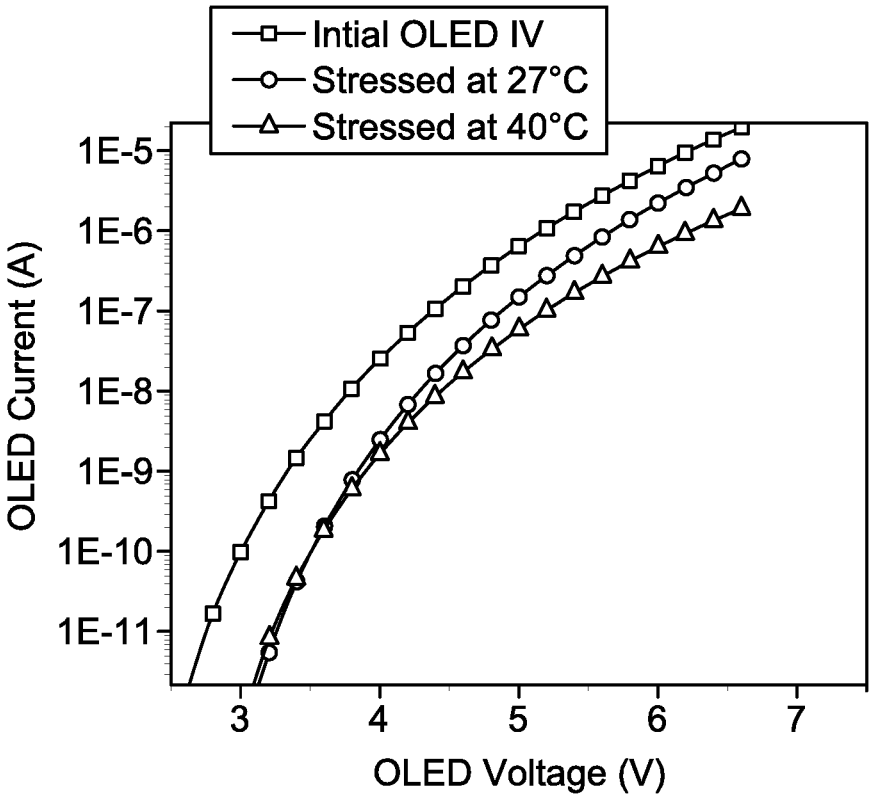
FIG. 16 is an example of the IV characteristic of an OLED subjected to three different stress conditions.

In another embodiment, one can look at the rates of change in different parameters in one device to identify the stress condition. For example, in the case of an OLED, the shift in voltage (or current) at different current levels (or voltage levels) can identify the stress conditions. FIG. 16 is an example of the IV characteristics of an OLED for three different conditions, namely, initial condition, stressed at 27° C., and stressed at 40° C. It can be seen that the characteristics change significantly as the stress conditions change.

Figure 17:
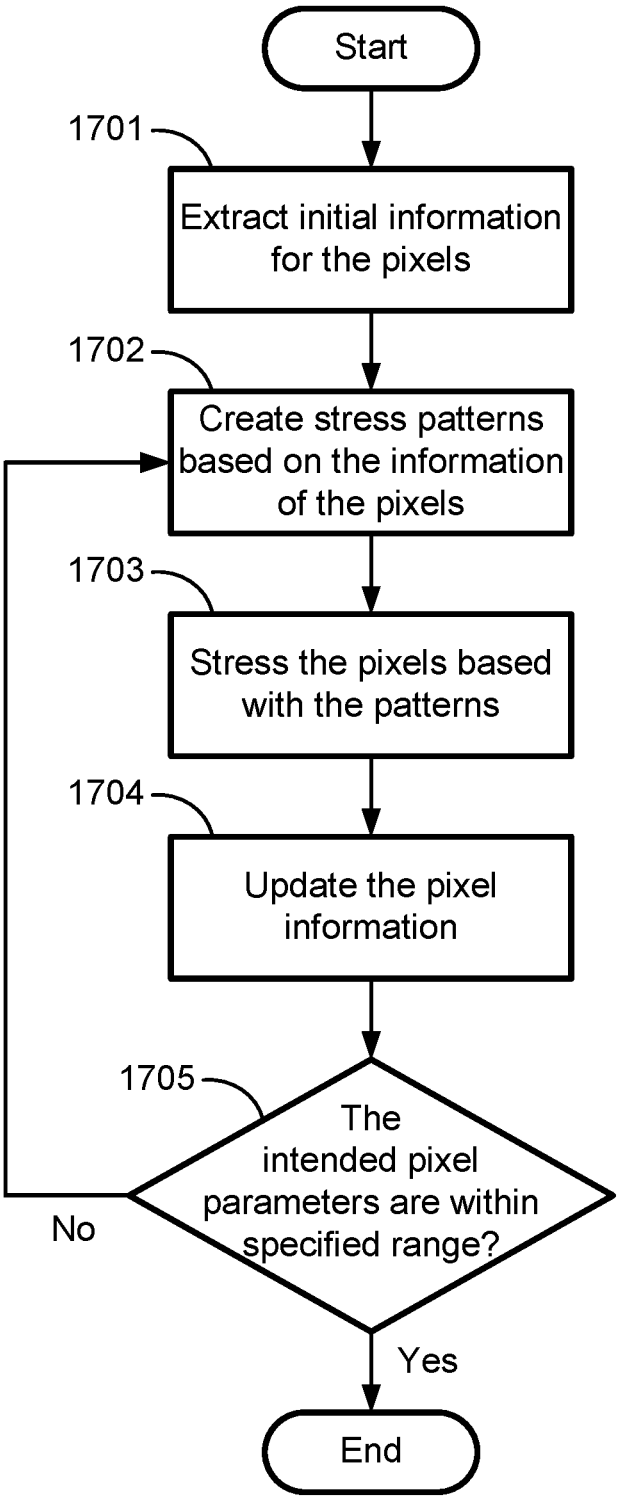
FIG. 17 is a flow chart of a procedure for achieving initial equalization of pixels in an emissive display.
Figure 18:
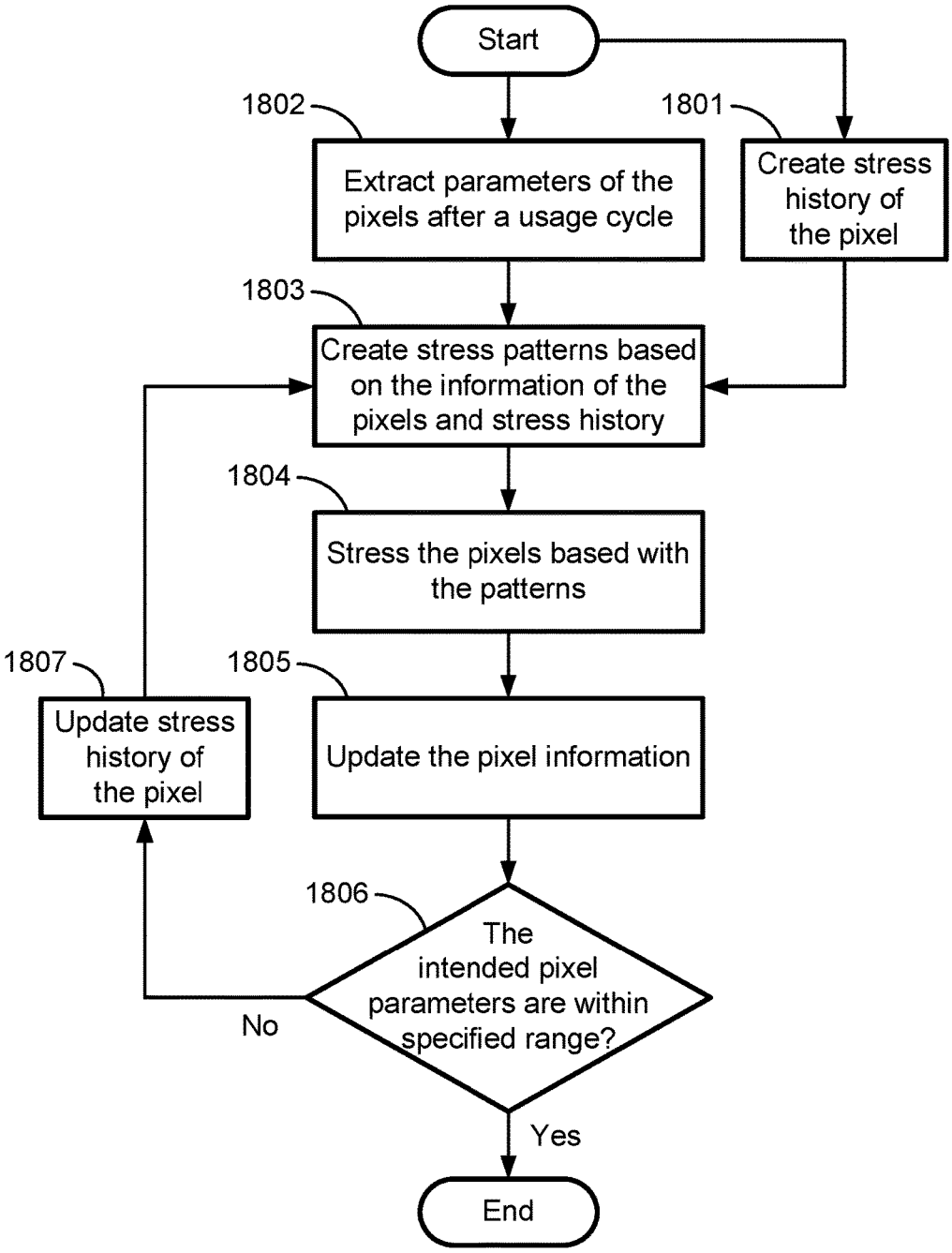
FIG. 18 is a flow chart of a procedure for achieving equalization of pixels in an emissive display after a usage cycle.

FIGS. 17 and 18 are flow charts of procedures for equalizing pixels in an emissive display panel having an array of pixels that include semiconductor devices that age under different ambient and stress conditions. FIG. 17 illustrates a procedure for achieving initial equalization of the pixels, and FIG. 18 illustrates a procedure for equalizing the pixels after a usage cycle.

In the procedure illustrated in FIG. 17, at least one pixel parameter (pixel information) is extracted from the emissive display panel at step 1701. These parameters are used to create stress patterns for the panel at step 1702. The stress patterns are applied to the panel at step 1703, and the pixel parameters are monitored and updated at step 1704 by extracting the pixel parameter from the stressed pixels. Step 1705 determines whether the pixel parameters extracted from the stressed pixels is within a preselected range, and if the answer is negative, steps 1702-1705 are repeated. This process continues until step 1705 produces a positive answer, which means that the pixel parameters extracted from the stressed pixels are within the preselected range, and thus the pixels are returned to normal operation.

The stress pattern can include duration and stress level. In one embodiment of the invention, the pixel parameters are monitored in-line during the stress to assure the parameters of the pixels do not pass the specified range. In another embodiment of the invention, the parameters of selected pixels or some reference pixels are monitored in-line during stress. In another embodiment of the invention, the pixels are stressed for a period of time and then the pixel parameters are extracted. After that the pixel parameters are updated and the stress pattern and timing can be updated with new data including new pixel parameters and the rate of change. For example, if the rate of change is fast, the stress intervals can be smaller to avoid passing the specified ranges for pixel parameters.

The setting for the parameters of the pixels can be variation between the parameters across the panel. In another embodiment it can be specific value.

In one example, the pixel information (or parameter) can be the threshold voltage of the drive TFT. Here, the stress condition of each pixel is defined based on its threshold voltage. In another example, the pixel parameter can be the voltage of the emissive devices (or the brightness uniformity).

The pixel information can be extracted through different means. One method can be through a power supply. In another case, the pixel parameters can be extracted through a monitor line.

In FIG. 18, the pixel parameters are extracted after a usage cycle. For example, the extraction can be triggered by a user, by a timer, or by a specific operating condition (e.g., being in charging mode). The stress history of the pixels is created during the usage cycle at step 1801, and the pixel parameters are extracted after the usage cycle at step 1801. The stress history can include the stress level during the operation and the stress time. In another embodiment, the stress history can be the average stress condition of the pixel during the usage cycle.

Based on the extracted pixel parameters and the stress history, stress patterns are generated at step 1803. Then the pixels are stressed at step 1804, in accordance with the generated stress pattern. The parameters of the stressed pixels are monitored and updated at step 1805 by extracting the pixel parameter from the stressed pixels. Step 1806 determines whether the pixel parameters extracted from the stressed pixels is within a preselected range, and if the answer is negative, step 1807 updates the stress history of the pixels, and then steps 1803-1806 are repeated. This process continues until step 1806 produces a positive answer, which means that the pixel parameters extracted from the stressed pixels are within the preselected range, and thus the pixels are returned to normal operation.

In one example, the pixels are assigned to different categories based on the stress history, and then the pixels are stressed with all the other categories that they are not assigned to. At the same time, the pixel parameters are monitored similar to the previous case to assure they do not pass the specified ranges.

In another example, the stress history has no timing information, and the change in pixel parameters can be used to identify the stress level and timing. For example, in one case, shift in the electrical characteristics of the emissive device can be used to extract the stress condition of each pixel for the stress pattern.

In yet another embodiment, the interdependency curves between pixel parameters and its optical performance can be used to extract the stress condition for each pixel. In the case of electrical characteristics of the emissive device, the interdependency curves can be used to find the worst case of efficiency degradation. Then, the delta efficiency between each pixel and the worst case can be determined. After that, the corresponding change in electrical characteristics of the emissive device of each pixel can be calculated to minimize the difference in efficiency between the pixel and the worst case. Then the pixels are stressed, and their pixel parameters (e.g., electrical characteristics of the emissive device) are monitored to reach the calculated shift. Similar operations can be used for other pixel parameters as well.

Efficiency degradation of electro-luminance devices can affect the performance of devices such as displays. This degradation is due to stress and other conditions such as temperature. Interdependency curves are the relation between an OLED's characteristics and its luminance degradation, therefore, interdependency curves are what connect the measurement data (electrical characteristics) to the characteristic (luminance degradation) that needs to be compensated for. For example, in the case of an emissive device, the electrical characteristics of the device can be measured easily. In one example, the OLED characteristic can be OLED voltage shift for a given current as a result of stress. However, the final characteristic that is required to be compensated for are its optical characteristics. In this case, the change in electrical characteristics due to aging (or other conditions) is measured and based on the interdependency curve one can determine how much the optical performance of the device is affected.

A correction algorithm fixes the drive circuit issues by extracting parameters related to the driver circuit and also fixes the optoelectronic device issues such as burn-in by extracting parameters from the device (or other related parameters) and with use of the interdependency curves. Interdependency curves thus show the relation between the extracted parameters (or stress history) for the optoelectronic device and its optical performance degradation.

One method of calculation of the correction factor involves extracting the relationship of the optical degradation and the given value of extracted parameter(s) as a function of stress level. The stress history of a pixel (or a group of pixels) is calculated, and based on the stress level, one or more interdependency curves are selected from different interdependency curves representing different stress levels. From the selected curves and the extracted parameters a correction factor is calculated as a function of the stress level. One simple function can be a linear approximation.

Using interdependency curves to solve the aging issues in optoelectronic devices can eliminate the need for optical sensors. However, some devices may experience different aging behavior as a function of temperature.

Figure 19:
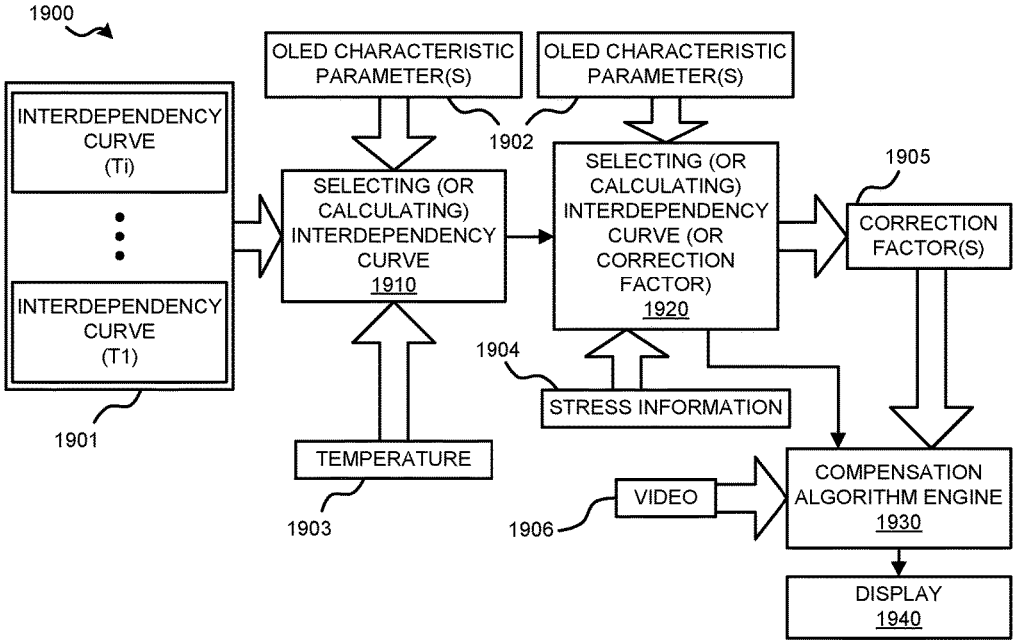
FIG. 19 is a flow chart of a procedure for incorporating temperature as an operating condition associated with the interdependency curves.
Figure 20:
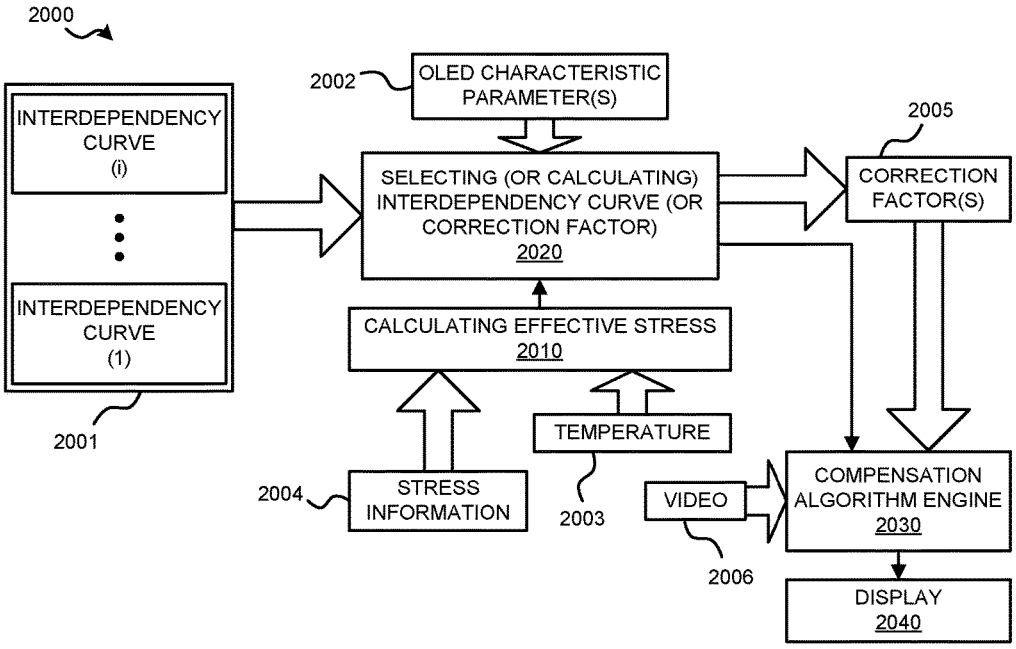
FIG. 20 is a flow chart of a procedure for incorporating temperature as a factor in an effective stress operating condition associated with the interdependency curves.

Referring now to FIG. 19 and FIG. 20, methods of determining correction factors for display compensation taking into account temperature will now be described.

In some optoelectronic devices, the temperature may affect the interdependency curves or as described below, an effective stress. As a result, the system needs to accommodate for the temperature effect as well as the stress levels as described hereinabove. Both the stress levels and the temperature are operating conditions which affect the interdependency curve. To accommodate for the temperature effect as well, the temperature profile of the panel is either measured or estimated and taken into account in the compensation of the display.

In one embodiment depicted in FIG. 20, a method of display compensation which takes into account temperature to extract correction factors from stored interdependency curves, will now be described. A number of interdependency curves based on different temperatures are stored 1901. For example, a number of curves stored for various stress levels, and for various temperatures T1, . . . Ti. After the temperature information 1903 for a pixel (or a group of pixels) is determined through some measurement or estimation, a set of interdependency curves are selected based on the temperature history for the pixel 1910. For example a number of various curves of various stress conditions which also are within some temperature threshold of the pixel temperature or temperature history are selected, or for each stress condition, interdependency curves corresponding to the closest higher temperature and closest lower temperature are selected for interpolation. In this embodiment the temperature of a pixel is periodically measured or estimated and stored as a temperature history of the pixel. As an alternative to selecting interdependency curves, a new interdependency curve is extracted or calculated for the pixel temperature based on a number of interdependency curves 1910, in which case the OLED characteristic parameter is used 1902 to reduce calculations as described below. For example, given a set of interdependency curves for N stress conditions, and for each stress condition M temperatures, when analyzing temperature first, for every stress condition, interpolation curves of the closest higher and lower temperatures are utilized to interpolate curves corresponding to that temperature for each stress condition. To reduce calculation and storage requirements the OLED characteristic of interest (the measure of OLED voltage shift for example) may be used to extract or generate only the points of interest on the new interpolated interdependency curves.

Next, from the selected set of the interdependency curves (or the calculated new interdependency curves or the points of interest) and stress information 1904 (and with use of the OLED characteristic parameter(s) 1902 if not used already to restrict calculation to points of interest) one or more pixel correction factors 1905 are calculated 1920. The one or more correction factors 1905 are used in the correction algorithm 1930 to fix for optical degradation of the optoelectronic device as described hereinabove, so that for example a video signal 1906 is displayed on the display 1940 accurately.

It is to be understood, that since the interdependency curves are stored for various stress conditions and various temperatures, the order of selection and/or calculation based on temperature and stress history 1910 1920 may be changed. For example, as an alternative to the above, given a set of interdependency curves for N stress conditions, and for each stress condition M temperatures, when analyzing stress conditions first, for every temperature within a threshold, interpolation curves of the closest higher and lower stress conditions are utilized to interpolate a curves corresponding the stress condition of the pixel for each close temperature condition. To reduce calculation and storage requirements the OLED characteristic of interest (the measure of OLED voltage shift for example) may be used to extract or generate only the points of interest on the new interdependency curves. Furthermore, a single selection and/or calculation taking into account both temperature and stress history may be utilized to generate appropriate at least one correction factors 1905. In such an algorithm, for example, the interdependency curves for various temperature and stress conditions could be interpolated in terms of both the temperature and stress information of the pixel to extract the correction factor corresponding to the OLED characteristic parameter 1902.

In the case of calculating a new interdependency curve for a given temperature based on a few of the stored interdependency curves 1901, the optoelectronic device characteristic parameters may be used to calculate required output for just those parameters to reduce the calculation load, i.e. generating only points of interest rather than generating entire interdependency curves. In some embodiments utilizing functional curve fitting, in calculating interdependency curves 1910 1920 the between value for each corresponding curve in the sets is extracted for the parameters and then a function is generated for the extracted values and temperature. Here, the value for the given temperature then is calculated based on that function. This is repeated for all the curves in the set.

In another embodiment depicted in FIG. 20, a method of display compensation which takes into account temperature to determine an effective stress, will now be described. As with the embodiment described in association with FIG. 19, a number of interdependency curves based on different stress conditions are stored 2001, e.g., stress conditions 1 . . . I, however in this case the interdependency curves are based on effective stress. In this embodiment, the effect of temperature is considered as a factor in the "effective stress" conditions. The effective stress is calculated 2010 using both the temperature history 2003 and the stress history 2004 of the pixel. Here, after the effective stress condition is calculated, optoelectronic device parameters 2002 are passed to the module to select proper curves for the correction factor calculation 2020. In some embodiments the curves with higher and lower effective stress are selected. Then from the selected set of the interdependency curves, the OLED characteristic parameter 2002, and effective stress information, the pixel correction factor 2005 is calculated 2020 which is used in the correction algorithm 2030 to fix for optical degradation of the optoelectronic device as described hereinabove, so that for example a video signal 2006 is displayed on the display 2040 accurately.

Here, since effective stress takes into account both temperature and standard stress conditions, one can change the order of incorporation of temperature and stress history into the calculations or mix them in one selection function.

For calculating an effective stress condition based on temperature, one can either use models or lookup tables. In some embodiments, the same model or lookup tables utilized to calculate the effective stress 2010 are used to generate and/or index the interdependency curves 2001.

One can mix the two methods described here to improve the correction factor calculation. In addition, if the temperature difference between a pixel (or a group of pixels) temperature and a reference temperature is larger than a threshold, calculation of the correction factor can be performed more often to reduce the effect of higher order conditions. For example, if there is a large temperature change for a short time, its effect might otherwise be ignored if the periodic update time for the OLED correction factor is too long.

Figure 21:
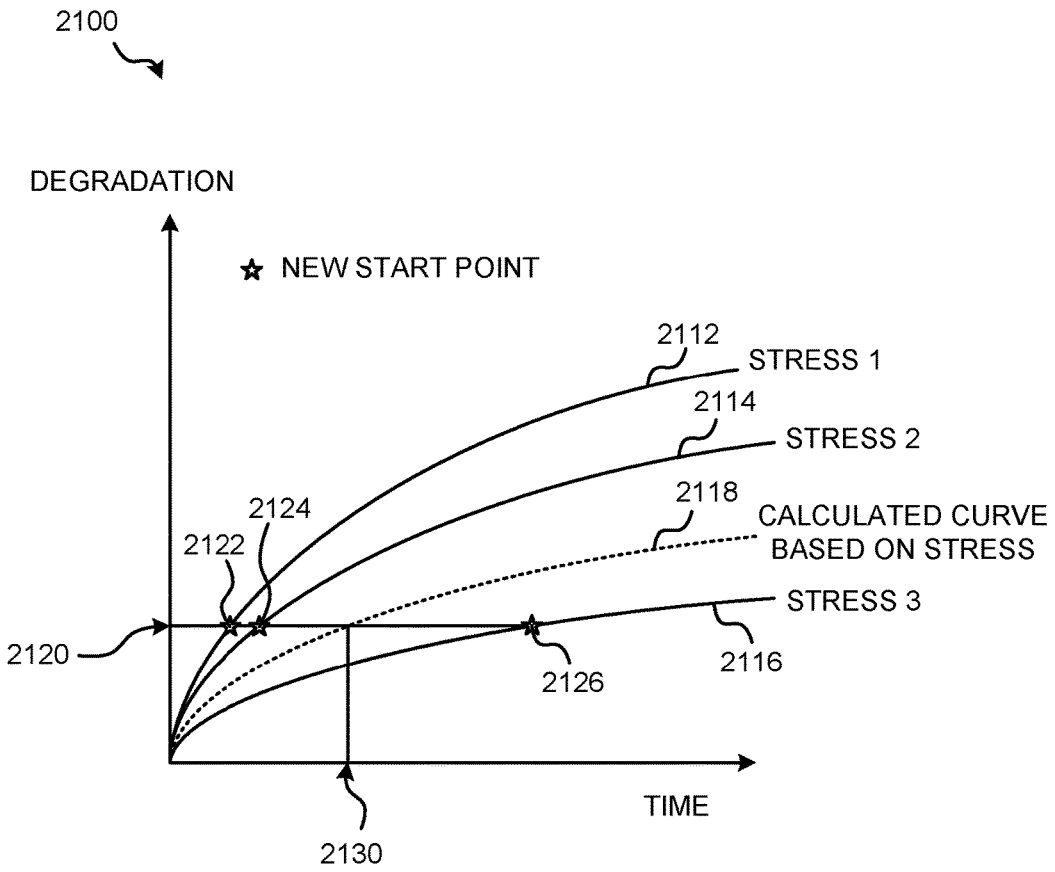
FIG. 21 depicts a set of curves for which new start points are determined for the next degradation update.

In another case, illustrated by FIG. 21, the stress history for a pixel (or group of pixels) can be reset and the start point in the interdependency curves for said pixel (or group of pixel) is shifted to the new extracted value. In some embodiments a current degradation is stored for the pixel in place of its stress history, and a stress time is tracked in place of the electrical characteristic. Instead of an interdependency curve, such an embodiment would rely on utilizing a set of degradation-time curves, each curve corresponding to various stress, temperature, initial device or other sets of operating conditions. In variations of this case, degradation or stress-time are used as the OLED parameters. Here, the time constant can be a fixed value or change depending on the stress level for each pixel.

After the degradation factor 2120 (or degradation factor as calculated from the correction factor) is updated with use of curves in calculations similar to as outlined above, either the degradation-time curve 2112, 2114, 2116 or the electrical-optical curves (not shown) corresponding to different stress conditions, the start-point of the curves can be reset for the next update. One method is finding the related x-index (e.g., stress-time) of the curve for the degradation value for each curve and using that as the new start point for those curves. For example in FIG. 21, a pixel was determined to have a related parameter "stress time" which has been determined separately to correspond to a particular value 2130 which, using the saved degradation (and in some embodiments a temporary stress history) and the calculated curve based on stress 2118, allowed extraction and calculation of the new degradation 2120. The new starting points then for the curves using the particular degradation factor 2120 correspond to 2122, 2124, and 2126. Although this method utilizing degradation-time curves dispenses with use of the OLED electrical characteristic and proceeds measuring stress time and tracking degradation, resetting of points as mentioned above may be performed in the context of interdependency curves as well. Since the degradation never "decreases" future calculations will lie along the curve which has not been discarded, and previous degradation along with the measured electrical operating parameters, temperature, and temporary stress history will serve to locate the start point from which to calculate the change in degradation at the time of the next update.

For embodiments which utilize degradation-time curves, the stress time can represent an actual time in which case a temporary stress history tracking actual stress on the pixel for a short time may be recorded. In other embodiments an effective stress time may be tracked which combines the actual stress level and time between each update for example as described hereinbelow.

Another method is to calculate the effective x-index from the stress (or temperature) level for each curve. This can be empirical or modeled for each curve, or it can be measured from different reference devices being stressed at different levels.

The new effective x-index can be used as the new start point for each curve.

The x-index could be time as shown in FIG. 21 or it can be another device parameter or temperature (or a function of a few parameters).

In one aspect, the stress history and temperature history of pixels (or group of pixels) are stored. During a status update period of the optoelectronic device, one or more interdependency curves are chosen based on temperature. Then from the stress history and selected interdependency curves a correction factor is calculated. Here, an electrical measurement from the optoelectronic device or a representative device can be used to fetch proper points from the interdependency curves.

In another aspect, the temperature is used in adjusting the stress history generating an effective stress. Here, based on the temperature and the luminance value (it can be also current, voltage or ON time) of the pixel, the effective stress is calculated. For example, if the pixel is program to offer L1, at higher temperature the "effective stress" of L1 can be similar to a "higher" stress case according to a standard of stress which does not take temperature into account.

In another aspect, if the temperature of a pixel (or a group of pixels) is significantly different from a reference temperature, the stress history calculation for said pixel (or the group of pixel) gets updated more often. In addition, the calculation for the correction factor based on the interdependency curves can also be performed more often.

In another aspect, the interdependency curves are the relation between stress time and luminance degradation of the OLED.

In another aspect, the interdependency curves are the relationship between OLED electrical characteristic and the luminance degradation of the OLED.

In another aspect, the stress history is reset to a default value after the correction factor is updated. Here, some other parameter is stored (in addition to retaining the degradation value or correction factor), to track the new origin point in the interdependency curves. For example, correction factor, time or extracted OLED parameter can be used, with the previous degradation or correction factor.

In some applications, the device performance may vary due to process variations. This can also affect the interdependency curve that a device will actually exhibit and hence affect the accuracy of calculations relying on interdependency curves which do not correspond to the device in question. It follows that the interdependency curves are a function of the initial status of the device. For example, in the case of printed OLEDs, the initial device characteristics of the OLED at different pixels or in different displays can vary due to process variation. This can also affect the aging behavior of the OLED and so influences the interdependency curve, i.e. the change in OLED electrical characteristics versus OLED efficiency degradation, exhibited by each pixel.

Figure 22:
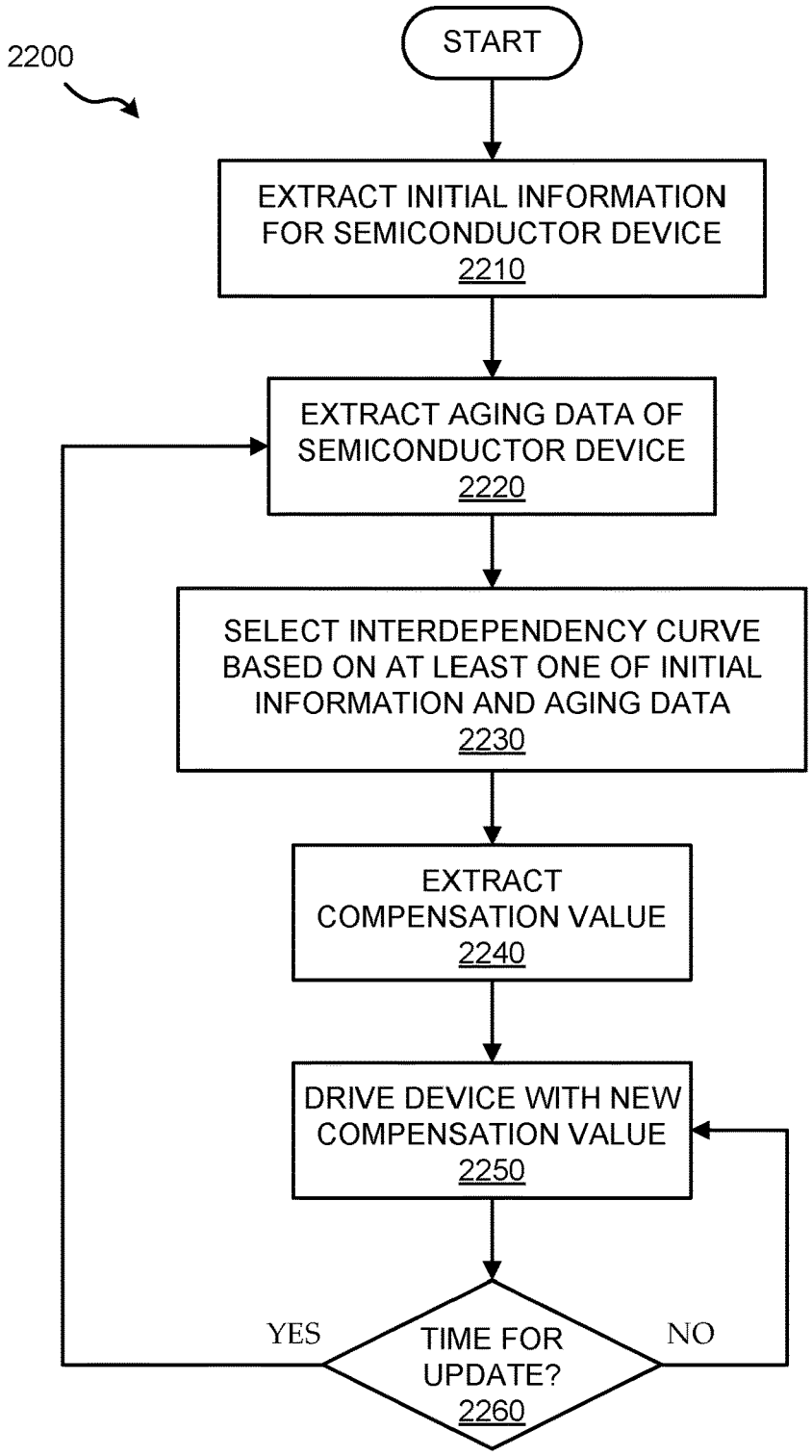
FIG. 22 is a flow chart of a procedure for incorporating initial device characteristics as an operating condition associated with the interdependency curves.

In the embodiment depicted in FIG. 22 a method 2200 for compensating a pixel based on initial device characteristics and interdependency curves first extracts information regarding the initial state or characteristics of a semiconductor device 2210. This generally should occur before the device is subjected to aging or stress in order to reflect accurately the initial state of the device. Once in operation and in need of compensation, the aging data, for example, the stress history for the pixel is then extracted for the semiconductor device 2230. The interdependency curves are chosen based on the initial status of the device and also possibly based on age or stress history 2230. A compensation value is then extracted 2240 for the device in a similar manner to that described hereinabove, utilizing the interdependency curves which have been tagged as pertaining to devices having similar initial characteristics to that of the device in question. As described, in some embodiments, a stress history is utilized to determine a compensation factor from interdependency curves of higher and lower stress conditions. The extracted compensation value is used for compensation, i.e. to drive the device 2250, until it is time for a next measurement or update cycle 2260.

Figure 23:
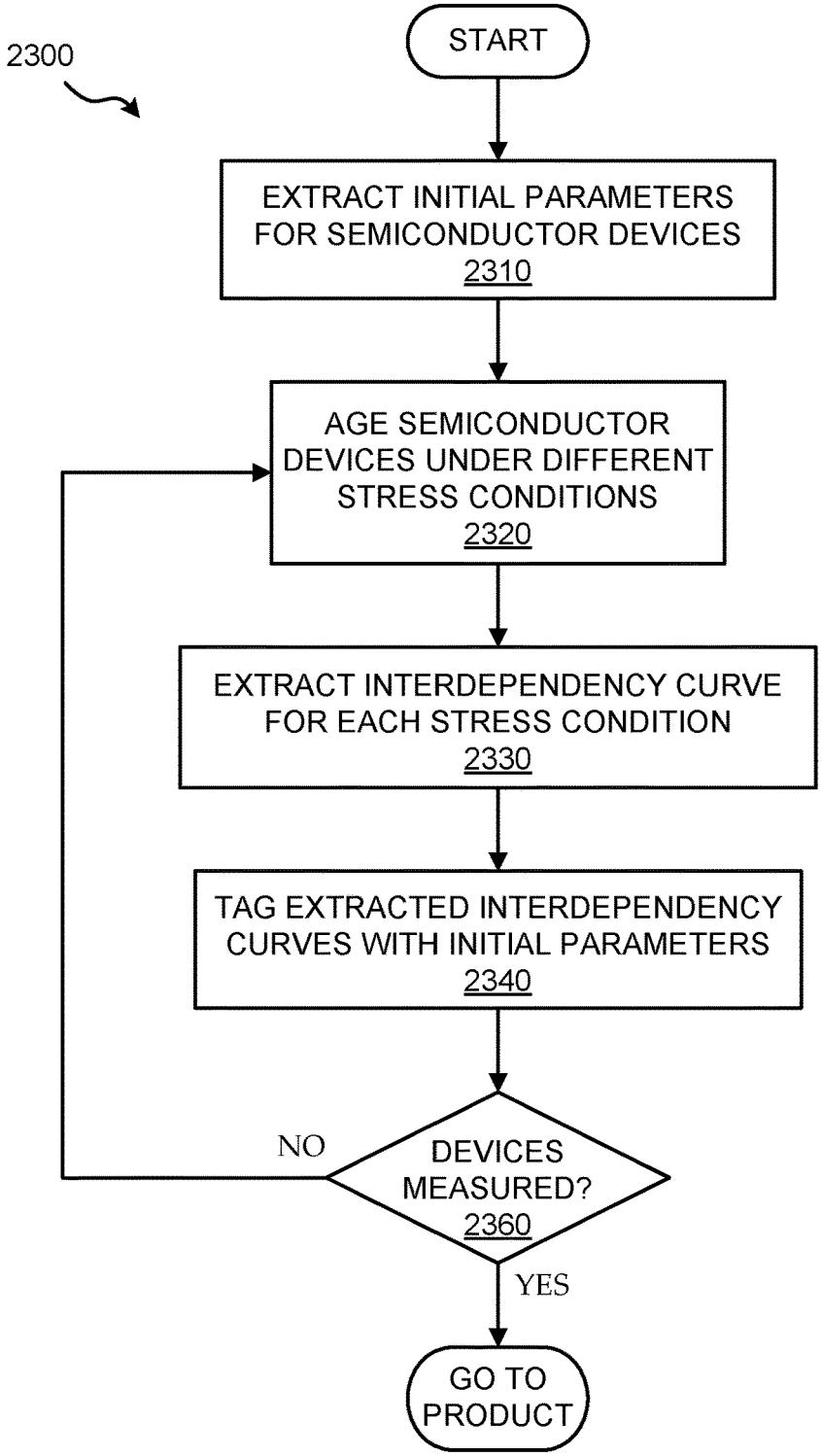
FIG. 23 is a flow chart of a procedure for extracting interdependency curves for use in compensation incorporating initial device characteristics as an operating condition.

As described above the interdependency curves include curves for various stress conditions and various initial device characteristics. With reference also to FIG. 23, in order to generate the interdependency curves for different values of initial characteristics, the devices used to extract the interdependency curves are first measured in the method 2300 for the same initial parameters which may correspond directly to specific measured characteristics or functions of them 2310. After that, the devices are aged or otherwise put under different stress conditions 2320 and the data are collected to extract the interdependency curves 2330. The interdependency curves are tagged with initial parameters 2340 until the devices are all measured 2360.

Figure 24:
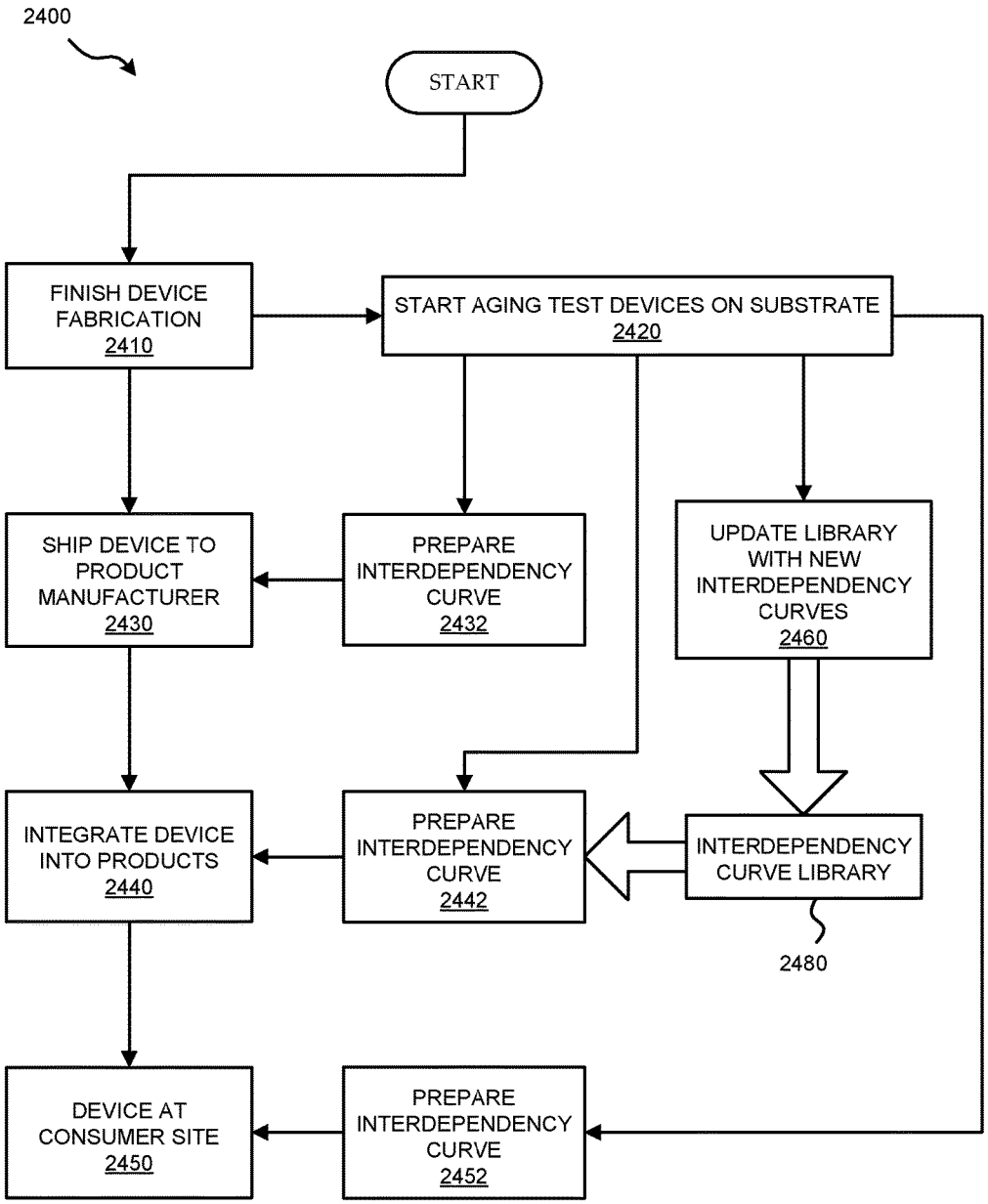
FIG. 24 is a flow chart of a procedure for updating remotely interdependency curves during product life cycle between device fabrication and the device operation at the consumer site.

Referring now to FIG. 24 a method 2400 utilized for updating interdependency curves will now be described. In some cases, the interdependency curves may vary significantly from one device (e.g., display or sensor) to another device (or from one batch to another batch). In this case, interdependency curves need to be extracted partially or entirely from the test units in the main substrates (or the main device themselves). In one case, there is a library that gets updated by every measurement and the interdependency curves are tagged with different signature parameters (which may include initial measurement). In this case, the device is shipped to the product manufacturer loaded with extracted initial interdependency curves selected from the library. These curves can be selected based on some data and measurement extracted from the panel.

In another aspect, test units go under different test conditions to extract interdependency curves directly or indirectly. In the case of indirect measurement, some parameters are extracted from the test units pointing to interdependency curves from the library. In one embodiment, test units from the same or similar batch are utilized to produce initial curves which are then utilized to select more complete curves (subjected to longer testing time) from the library.

The interdependency curves then can be updated at different stages: at product manufacturing or at a consumer site. In addition, the new data extracted may be used to update the interdependency curve library. In some embodiments updates are performed remotely, i.e. even when the device is remote from the origin of the interdependency curve library or the aging of the test devices and the preparation of the interdependency curves.

Referring specifically to the steps of the method 2400, once the device fabrication is complete 2410, test devices on a substrate are aged 2420 continually, interdependency curves are prepared. The device is shipped to the product manufacturer, for example a display with an array of OLEDs 2430. In one case aging 2420 is performed on test devices of the device itself also, in which case the prepared interdependency curves measured from that display are shipped with the device 2430. At the point in time of shipping the prepared interdependency curves may be provided to the manufacturer. In either case, the aging of the test devices continues 2420 and further interdependency curves are prepared 2442 so that by the time there is integration of the devices into the products 2440 there is another opportunity to update the shipped device with calculated interdependency curves. The aging of the test devices continues 2420 and yet further interdependency curves are prepared 2452 so that by the time the device in the product is at the consumer site 2450 there is another opportunity to update the shipped device with calculated interdependency curves. In some embodiments updates are provided over the internet. In some embodiments, preparing the interdependency curves 2432, 2442, 2452 and updating those of the shipped device at various points in time utilizes data from testing devices 2420 from the same or similar batch of devices as those that went into the product.

Optionally the process can include updating a central library with interdependency curves 2460 stored in an interdependency curve library 2480, which can collect data from multiple devices and batches of devices and serve as a comprehensive repository for similar devices and which can be used to update the interdependency curves of the shipped device at various points in time from fabrication to operation at a consumer site. In some embodiments, interdependency curves of the library 2480, each of which may for example contain data representing a many hours of stress testing, are only chosen to augment those of the shipped device when they are close a enough match to those curves already associated with the shipped device, such as for example initial interdependency curves which contain data representing fewer hours of stress testing. Although FIG. 24 depicts utilization of the interdependency curve library 2480 at the time of integration 2440 it should be understood that interdependency library 2480 may be utilized at any point in time from fabrication to the device being present at the consumer site.

Modelling can be one approach to fix the burn-in effects caused by pixel stress. However, keeping long stress histories for every pixel and also other parameters requires significant memory. Another issue is that proper modelling is very complicated due to the multi-input system with long input dynamic range. Moreover, process variations cause divergence in the real performance of the device from that predicted by the model.

Figure 25:
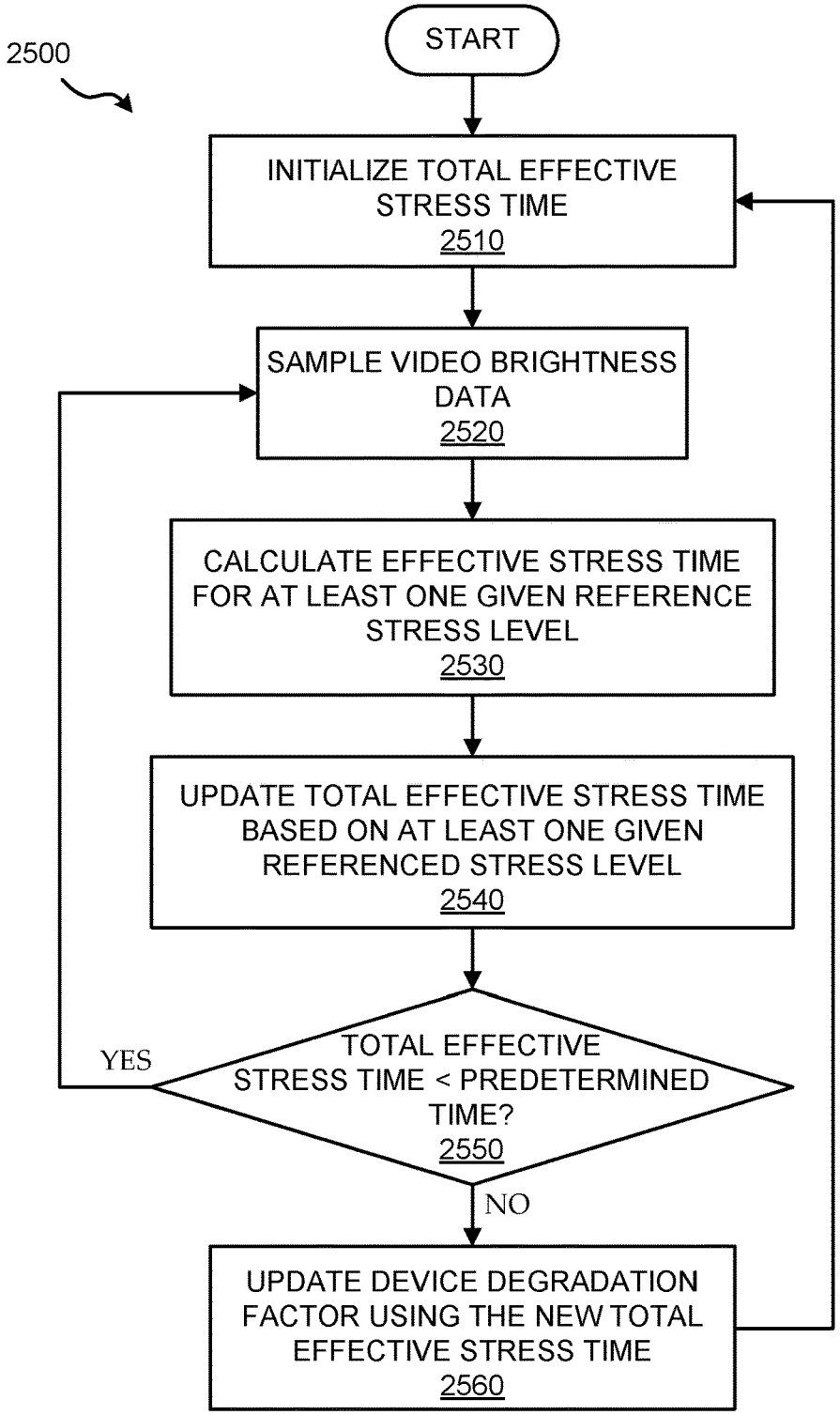
FIG. 25 is a flow chart of a simplified method of compensation utilizing interdependency or degradation-time curves and effective stress time.
Figure 26:
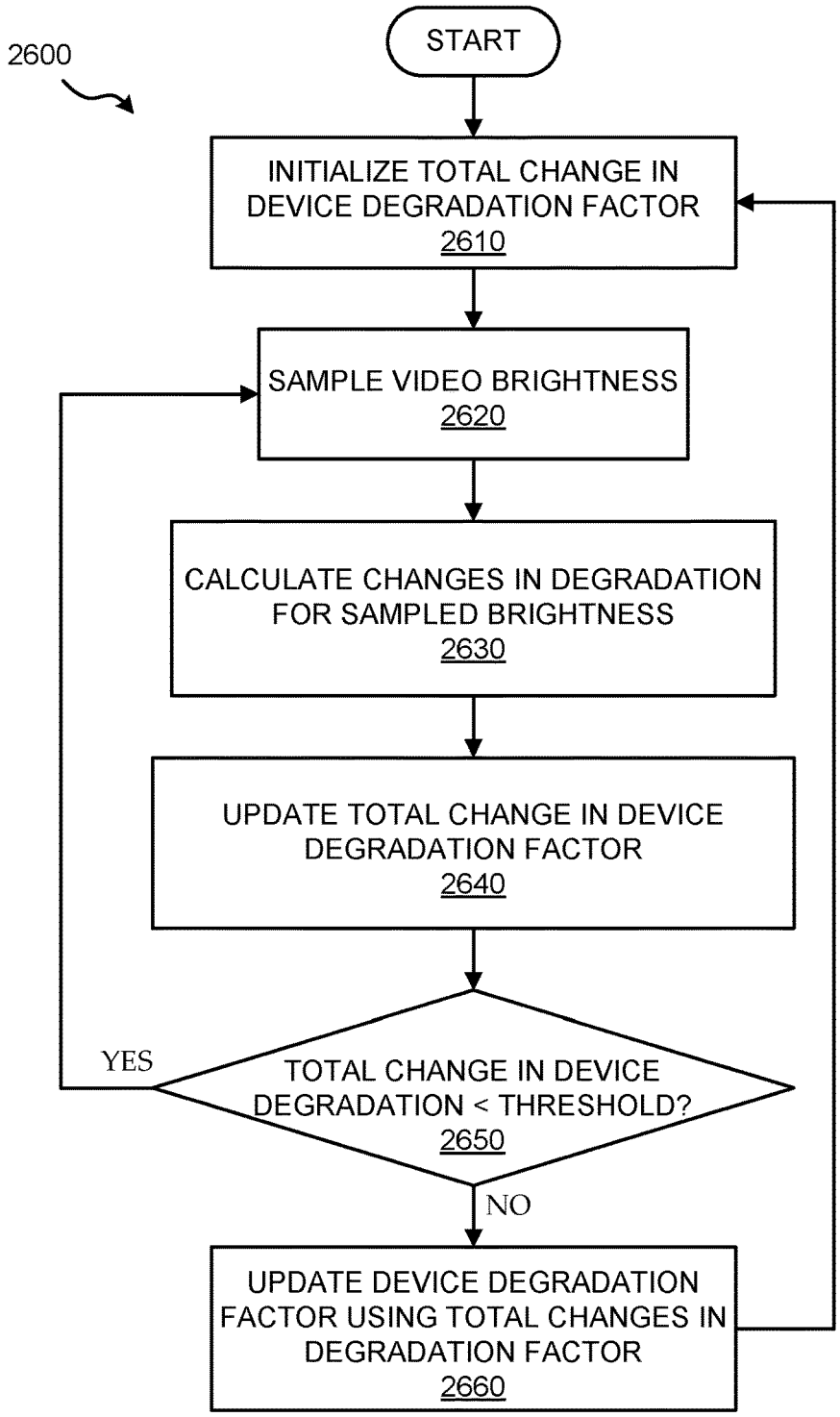
FIG. 26 is a flow chart of a simplified method of compensation utilizing interdependency or degradation-time curves and degradation.

The following embodiments illustrated in FIG. 25 and FIG. 26 addresses the above issues while offering a relatively simple approach for extracting the degradation factor (and/or correction factor) for each pixel or group of pixels.

FIG. 25 shows an embodiment which is a method of display compensation 2500 which utilizes a total effective stress time and an effective stress time to address the issues. The effective stress time is a single quantity calculated from a number of possible stress conditions as well as an actual time duration of stress under those conditions. To provide an objective quantification of the effective stress time, a reference stress is utilized which is defined by a number of operational conditions such a reference temperature and a reference stress level etc. The effective stress time is the equivalent time required for the reference stress conditions to degrade a pixel by that which the actual pixel has degraded under various actual stress conditions during an actual duration. Determination of this effective stress time in increments allows for calculation and update of a total effective stress which is tracked for the pixel between updates of the degradation factor.

First, a total effective stress time is initialized 2510. Here, the total effective stress time for each pixel or group of pixels are set to a known value (for example zero). Alternatively, after calculating the degradation value during a previous update, the remaining or residual value which otherwise would have been rounded off and lost due to the data resolution in degradation factor is used to calculate the initial value for the effective stress time.

After the total effective stress time is initialized, video brightness data is sampled 2520. In one case, after a fixed time the pixel value is sampled. The sampling time should be less than the frequency of change in the pixel data. In another case, if there is a significant change in the pixel value, the previous value and its time on the panel is used as the sampled video brightness data and the new value is used for calculating the new stress time. One can also use a combination of both.

In another case, temperature is sampled in addition to sampling the video data and time. In this case, temperature change can also be used as a trigger value for sampling the video data. For example, once the temperature change exceeds a threshold new video data is sampled.

Once the video brightness data has been sampled 2520, the effective stress time for at least one given reference stress level is calculated. Here, if one or two reference stress conditions are used, then the stress time of the pixel under sampled stress is translated to said reference conditions. For this translation, also one can use temperature as one of the translation factors. For example, the sampled video data, stress time, and temperature of the pixel are used to calculate the effective stress time for a given reference stress value, at a given temperature level 2530.

In one case, several degradation curves based on different stress and different temperature are stored. For a sampled temperature level, corresponding curves are selected. From the selected curves the conversion factor of the stress time for the sampled stress to the effective stress time of a given reference stress level is calculated. If there is no direct curve for the sampled temperature, the curves are extracted from the existing curves first. The calculation can be performed in reverse order. In this case, the curves for given sampled stress are extracted first and then the conversion factor for the temperature is calculated. Once the effective stress time for the pixel has been calculated the total effective stress for the pixel is updated 2540. The total effective stress replaces the stress history normally utilized in the process of determining from the interdependency curves the degradation factor as described hereinabove. The effective stress time therefor acts to effectively calculate the change in the total effective stress of a pixel from the various conditions contributing to effective stress since the last degradation factor update. In some embodiments, degradation-time curves are stored and utilized in the calculations. In other embodiments, a single degradation-time curve, having the single reference conditions is stored.

To simplify the calculation, one can linearize the curves around the degradation factor to calculate the change in the degradation factor for a given video data and stress time.

After some conditions are satisfied 2550 the degradation factor is updated 2560 otherwise another sample is taken 2520. These conditions can be a threshold for total effective stress time or the change in degradation factor. Here, the threshold value can be dynamic. For example, when the degradation factor changes faster, the threshold predetermined time value can be smaller to accommodate the faster degradation. The threshold parameters' value for this decision can be different for each pixel. In some embodiments, the threshold is set to ensure that only once the total effective stress time has accumulated by an amount having a magnitude of sufficient significance, is the degradation factor updated. As mentioned above any residual which would be rounded off can be used as the value to initialize the total effective stress time during the next update.

In updating the degradation factor 2560, from the effective stress time and the previous degradation factor, the change in degradation is calculated. After updating the change in degradation, the degradation factor itself is updated. In one case, after the degradation factor is calculated, the error due to quantization and other factors is calculated to be used as part of the calculation of the new initial value for the total effective stress time.

FIG. 26 shows an embodiment of a method 2600 for updating the degradation factor without relying upon effective stress time calculations, but rather estimating the direct effect various operating conditions and stresses have on degradation.

First, the total change in degradation factor is initialized 2610. Here, the change in the degradation factor for each pixel or group of pixels are set to a known value (for example zero). Alternatively, after calculating the degradation value of a previous update, the remaining or residual value due to the resolution in the degradation factor which otherwise would have been rounded off during the last update is used to initialize the total change in degradation factor.

After the change in degradation factor is initialized, video brightness is sampled 2620. In one case, after a fixed time the pixel value is sampled. The sampling time should be less than the frequency of change in the pixel data. In another case, if there is a significant change in the pixel value, the previous value and its time on the panel is used as the sampled video brightness data and the new value is used. One can also use a combination of both. In another case, temperature is sampled in addition to sampling the video data and time. In this case, temperature change can also be used as a trigger value for sampling the video data. For example, once the temperature change exceeds a threshold new video data is sampled.

Once the video brightness data has been sampled 2620, a resulting change in degradation factor is calculated 2630. For example, the sampled video data, stress time, degradation factor, and temperature are used to calculate the change in the degradation factor.

In one case, several degradation curves based on different stress and different temperature are stored. For a sampled temperature level, corresponding curves are selected. From the selected curves, the change in degradation factor can be calculated based on the degradation factor, the sampled stress, and stress time. If there is no direct curve for the sampled temperature, the curves are extracted from the existing curves first. The calculation can be performed in reverse order. In this case, the curves for given sampled stress are extracted first and then the change in the degradation factor for the temperature is calculated. In a similar manner to embodiments described hereinabove, histories of the pixel are discarded by adopting new starting points for the degradation-time or interdependency curves. As such a degradation factor is stored for each pixel i.e. OLED, and updated.

To simplify the calculation, one can linearize the curves around the degradation factor to calculate the change in the degradation factor for a given video data and stress time.

After some conditions are satisfied 2650 the degradation factor is updated 2560 otherwise another sample is taken 2620. These conditions can be a threshold for the change in degradation factor. Here, the threshold value can be dynamic. For example, when the degradation factor changes faster, the degradation threshold value can be smaller to accommodate the faster degradation. The threshold parameters' value for this decision can be different for each pixel.

In updating the degradation factor 2660, the change in degradation factor is added to the degradation factor. In one case, after the new degradation factor is calculated, the error due to quantization and other factors is calculated to be used as the initial value for change in the degradation factor. In some embodiments, the threshold is set to ensure that only once the total change in device degradation has accumulated by an amount having a magnitude of sufficient significance, is the degradation factor updated. As mentioned above any residual which would be rounded off can be used as the value to initialize the total change in device degradation during the next update.

Compensation for OLED efficiency degradation based on electrical characteristics of the OLED devices is prone to error due to different aging conditions. One solution is to keep history of the aging, for example stress and temperature histories, of each pixel (or a group of the pixel). This may require significant memory size. To address that, event driven stress history was developed which reduces the memory size significantly. Further, to reduce the system complexity and eliminate the need for memory, the new embodiment uses the rate of change in the OLED characteristic as an indicator for correcting the aging of the OLED.

$$\text{OLED correction}=f(V_{OLED} \text{ or } I_{OLED}, dV_{OLED}/dt \text{ or } dI_{OLED}/dt)$$

Here, different interdependency curves can be used for correcting the OLED efficiency degradation. To select the curve, one can use the rate of change. The higher the aging rate at a certain aging point can be an indicator of the stress status.

Although the above shows the function specifically with respect to voltage or current and the change in voltage or current other parameters of an interdependency curve may be used.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A method of compensating for efficiency degradation of an organic light emitting device (OLED) in an array-based semiconductor device having arrays of pixels that include OLEDs, said method comprising:

determining, for a plurality of operating conditions, interdependency curves relating changes in an electrical operating parameter of said OLEDs and the efficiency degradation of said OLEDs in said array-based semiconductor device, the plurality of operating conditions comprising at least two operating condition types;

determining at least one operating condition for the OLED in respect of the at least two operating condition types;

measuring the electrical operating parameter of said OLED;

determining an efficiency degradation of said OLED using said interdependency curves, said at least one operation condition for the OLED, and said measured electrical operating parameter;

determining a correction factor for the OLED with use of said efficiency degradation;

and compensating for said efficiency degradation with use of said correction factor;

wherein the at least two operating condition types comprise a temperature condition and a stress condition, and the at least one operation condition for the OLED comprises a temperature history and a stress history;

wherein each interdependency curve has an associated temperature condition and a stress condition, and wherein determining an efficiency degradation comprises:

determining at least one temperature associated interdependency curve with use of said temperature history; and determining from said at least one temperature associated interdependency curve and said stress history and said measured electrical operating parameter, the efficiency degradation of the OLED; and wherein after the correction factor for the OLED has been determined, a start point associated with the interdependency curves is reset.

2. The method of claim 1, wherein determining the efficiency degradation comprises:

initializing a total effective stress time value;

sampling brightness data for said OLED;

calculating an effective stress time corresponding to said sampling for at least one given reference stress level;

updating the total effective stress time for said OLED based on the at least one given stress level;

determining whether to sample more brightness data; and in a case no more brightness data are to be sampled, updating the efficiency degradation with use of the total effective stress, and the interdependency curves.

3. The method of claim 2, wherein determining whether to sample more brightness data comprises comparing the total effective stress time with a predetermined threshold.

4. The method of claim 1, wherein determining the efficiency degradation comprises:

initializing a total change in degradation factor;

sampling brightness data for said OLED;

calculating a change in degradation corresponding to the sampled brightness;

updating the total change in degradation factor for said OLED;

determining whether to sample more brightness data; and in a case no more brightness data are to be sampled, updating the efficiency degradation with use of the total change in degradation factor, and the interdependency curves.

5. The method of claim 4, wherein determining whether to sample more brightness data comprises comparing the total change in degradation factor with a predetermined change in degradation threshold.

6. A method of compensating for efficiency degradation of an organic light emitting device (OLED) in an array-based semiconductor device having arrays of pixels that include OLEDs, said method comprising:

determining, for a plurality of operating conditions, interdependency curves relating changes in an electrical operating parameter of said OLEDs and the efficiency degradation of said OLEDs in said array-based semiconductor device, the plurality of operating conditions comprising at least two operating condition types;

determining at least one operating condition for the OLED in respect of the at least two operating condition types;

measuring the electrical operating parameter of said OLED;

determining an efficiency degradation of said OLED using said interdependency curves, said at least one operation condition for the OLED, and said measured electrical operating parameter;

determining a correction factor for the OLED with use of said efficiency degradation;

and compensating for said efficiency degradation with use of said correction factor;

wherein the at least two operating condition types comprise a temperature condition and a stress condition, and the at least one operation condition for the OLED comprises a temperature history and a stress history;

wherein each interdependency curve has an associated effective stress history as a function of at least the temperature condition and the stress condition, and wherein determining an efficiency degradation comprises:

determining an effective stress history for the OLED with use of the temperature history and the stress history; and determining from said interdependency curves and said effective stress history and said measured electrical operating parameter the efficiency degradation of the OLED; and wherein after the correction factor for the OLED has been determined, a start point associated with the interdependency curves is reset.

7. A method of compensating for efficiency degradation of an organic light emitting device (OLED) in an array-based semiconductor device having arrays of pixels that include OLEDs, said method comprising:

determining, for a plurality of operating conditions, interdependency curves relating changes in an electrical operating parameter of said OLEDs and the efficiency degradation of said OLEDs in said array-based semiconductor device, the plurality of operating conditions comprising at least two operating condition types;

determining at least one operating condition for the OLED in respect of the at least two operating condition types;

measuring the electrical operating parameter of said OLED;

determining an efficiency degradation of said OLED using said interdependency curves, said at least one operation condition for the OLED, and said measured electrical operating parameter;

determining a correction factor for the OLED with use of said efficiency degradation;

and compensating for said efficiency degradation with use of said correction factor;

wherein the at least two operating condition types comprise a temperature condition and an initial device characteristic condition, and the at least one operation condition for the OLED comprises a temperature history and initial device characteristics;

wherein each interdependency curve has an associated initial device characteristic condition and a stress condition, and wherein determining an efficiency degradation comprises:

determining at least one initial device characteristic associated interdependency curve with use of said initial device characteristics; and determining from said at least one initial device characteristic associated interdependency curve and said stress history and said measured electrical operating parameter, the efficiency degradation of the OLED;

wherein determining for a plurality of operating conditions interdependency curves comprises:

extracting initial characteristics for each of a plurality of test OLEDs;

repeatedly subjecting the test OLEDs to different stress conditions until all test OLEDs are measured; and extracting interdependency curves for said test OLEDs and storing said interdependency curves such that each interdependency curve is associated with at least one stress condition and an initial device characteristic condition; and further comprising updating remotely a set of interdependency curves stored with the array-based semiconductor device with a set of prepared interdependency curves from a remote interdependency curve library at least twice after fabrication of the array-based semiconductor device;

wherein the updating remotely occurs at least twice including: shipping the array-based semiconductor device to the manufacturer, integrating the array-based semiconductor device into a product, and operation of the array-based semiconductor device at a consumer site.

* * * * *